US010995397B2

(12) United States Patent
Leyvraz et al.

(10) Patent No.: US 10,995,397 B2
(45) Date of Patent: May 4, 2021

(54) ALUMINUM ALLOYS AND METHODS OF MAKING THE SAME

(71) Applicant: Novelis Inc., Atlanta, GA (US)

(72) Inventors: David Leyvraz, Sierre (CH); Jonathan Friedli, Sion (CH); Aude Despois, Valais (CH); Guillaume Florey, Valais (CH)

(73) Assignee: NOVELIS INC., Atlanta, GA (US)

( * ) Notice: Subject to any disclaimer, the term of this patent is extended or adjusted under 35 U.S.C. 154(b) by 544 days.

(21) Appl. No.: 15/838,844

(22) Filed: Dec. 12, 2017

(65) Prior Publication Data

US 2018/0171453 A1 Jun. 21, 2018

Related U.S. Application Data

(60) Provisional application No. 62/529,516, filed on Jul. 7, 2017, provisional application No. 62/435,437, filed on Dec. 16, 2016.

(51) Int. Cl.

| | |
|---|---|
| ***C22F 1/05*** | (2006.01) |
| ***C22C 21/04*** | (2006.01) |
| ***C22C 21/08*** | (2006.01) |
| ***C22F 1/00*** | (2006.01) |

(52) U.S. Cl.
CPC ..... *C22F 1/05* (2013.01); *C22C 21/04* (2013.01); *C22C 21/08* (2013.01); *C22F 1/002* (2013.01)

(58) Field of Classification Search
CPC ..... C22C 21/12–18; C22F 1/06
See application file for complete search history.

(56) References Cited

U.S. PATENT DOCUMENTS

| | | | | |
|---|---|---|---|---|
| 4,174,232 | A | 11/1979 | Lenz et al. | |
| 10,533,243 | B2 | 1/2020 | Newman et al. | |
| 10,550,455 | B2 | 2/2020 | Hosch et al. | |
| 2005/0028894 | A1 | 2/2005 | Hoffmann et al. | |
| 2005/0288894 | A1 | 12/2005 | Vorenkamp et al. | |
| 2015/0354044 | A1 | 12/2015 | Shishido et al. | |
| 2016/0201158 | A1 | 7/2016 | Kamat et al. | |
| 2017/0009325 | A1 | 1/2017 | Wyatt-mair et al. | |
| 2017/0175240 | A1* | 6/2017 | Wen | C22F 1/05 |

FOREIGN PATENT DOCUMENTS

| | | |
|---|---|---|
| CN | 1158148 | 8/1997 |
| CN | 101509114 | 8/2009 |
| CN | 101550509 | 10/2009 |

(Continued)

OTHER PUBLICATIONS

AU2017375790 , "First Examination Report", dated Sep. 20, 2019, 3 pages.

(Continued)

*Primary Examiner* — Lois L Zheng
(74) *Attorney, Agent, or Firm* — Kilpatrick Townsend & Stockton LLP

(57) ABSTRACT

Disclosed are high-strength aluminum alloys and methods of making and processing such alloys. More particularly, disclosed are aluminum alloys exhibiting improved mechanical strength. The processing method includes homogenizing, hot rolling, solutionizing, and multiple-step quenching. In some cases, the processing steps can further include annealing and/or cold rolling.

20 Claims, 19 Drawing Sheets

(56) References Cited

FOREIGN PATENT DOCUMENTS

| | | |
|---|---|---|
| CN | 102732760 | 10/2012 |
| CN | 103320728 | 9/2013 |
| CN | 104114726 | 10/2014 |
| CN | 104981555 | 10/2015 |
| CN | 107475584 | 12/2017 |
| EP | 2987879 | 2/2016 |
| JP | H05302154 | 11/1993 |
| JP | H09268356 | 10/1997 |
| JP | H10502973 | 3/1998 |
| JP | 2004211177 | 7/2004 |
| JP | 2004526061 | 8/2004 |
| JP | 2004527658 | 9/2004 |
| JP | 2007523262 | 8/2007 |
| JP | 2009007617 | 1/2009 |
| JP | 2009041045 | 2/2009 |
| JP | 2010116594 | 5/2010 |
| JP | 2013023747 | 2/2013 |
| JP | 2014143299 | 8/2014 |
| JP | 2016020530 | 2/2016 |
| JP | 2016522320 | 7/2016 |
| JP | 2016141842 | 8/2016 |
| RU | 2163940 | 3/2001 |
| RU | 2221891 | 1/2004 |
| WO | 9603531 | 2/1996 |
| WO | 02090608 | 11/2002 |
| WO | 02090609 | 11/2002 |
| WO | 2014046010 | 3/2014 |
| WO | 2016190408 | 12/2016 |

OTHER PUBLICATIONS

PCT/US2017/065766 , "International Preliminary Report on Patentability", dated Jun. 27, 2019, 8 pages.

Guo et al., "Enhanced Bake-Hardening Response of an Al—Mg-Sicu Alloy with Zn Addition", Materials Chemistry and Physics, vol. 162, Jul. 15, 2015, pp. 15-19.

International Application No. PCT/US2017/065766 , "International Search Report and Written Opinion", dated Feb. 22, 2018, 12 pages.

Shen , "Pre-Treatment to Improve the Bake-Hardening Response in the Naturally Aged Al—Mg—Si Alloy", Journal of Materials Science & Technology, vol. 27, No. 3, Jan. 1, 2011, pp. 205-212.

The Alumininum Association, Inc. , "International Alloy Designations and Chemical Composition Limits for Wrought Aluminum and Wrought Aluminum Alloys", Registration Record Series: Teal Sheets, Feb. 1, 2009, 35 pages.

Russian Application No. 2019119558 , "Office Action", dated Feb. 6, 2020, 13 pages.

European Application No. 17830057.0 , "Office Action", dated Mar. 18, 2020, 6 pages.

AU2017375790 , "Notice of Acceptance", dated Feb. 27, 2020, 3 pages.

Chinese Application No. 201780077507.9 , Office Action, dated Jul. 24, 2020, 25 pages.

Japanese Application No. 2019-531210, Office Action, dated Jul. 28, 2020, 24 pages.

* cited by examiner

ALUMINUM ALLOYS AND METHODS OF MAKING THE SAME

CROSS-REFERENCE TO RELATED APPLICATIONS

This application claims the benefit of U.S. Provisional Application No. 62/435,437, filed Dec. 16, 2016 and titled "Aluminum Alloys and Methods of Making the Same"; and U.S. Provisional Application No. 62/529,516, filed Jul. 7, 2017 and titled "Aluminum Alloys and Methods of Making the Same," the contents of all of which are incorporated herein by reference in their entireties.

TECHNICAL FIELD

The present disclosure relates to aluminum alloys and related methods.

BACKGROUND

Recyclable aluminum alloys with high strength are desirable for improved product performance in many applications, including transportation (encompassing without limitation, e.g., trucks, trailers, trains, and marine) applications, electronic applications, and automobile applications. For example, a high-strength aluminum alloy in trucks or trailers would be lighter than conventional steel alloys, providing significant emission reductions that are needed to meet new, stricter government regulations on emissions. Such alloys should exhibit high strength. However, identifying processing conditions and alloy compositions that will provide such an alloy has proven to be a challenge.

SUMMARY

Covered embodiments of the invention are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

Disclosed is a method of producing an aluminum alloy comprising casting a cast aluminum product; homogenizing the cast aluminum product; hot rolling the cast aluminum product to an aluminum alloy body of a first gauge; optionally cold rolling the aluminum alloy body of the first gauge to an aluminum alloy plate, shate or sheet of a second gauge; solutionizing the aluminum alloy plate, shate or sheet; quenching the aluminum alloy plate, shate or sheet; coiling the aluminum alloy plate, shate or sheet into a coil; pre-aging the coil; and optionally aging the coil.

In some non-limiting examples, the quenching step can comprise a multi-step quenching process comprising a first quench to a first temperature and a second quench to a second temperature. In some examples, the aluminum alloy can include about 0.45-1.5 wt. % Si, about 0.1-0.5 wt. % Fe, up to about 1.5 wt. % Cu, about 0.02-0.5 wt. % Mn, about 0.45-1.5 wt. % Mg, up to about 0.5 wt. % Cr, up to about 0.01 wt. % Ni, up to about 0.1 wt. % Zn, up to about 0.1 wt. % Ti, up to about 0.1 wt. % V, and up to about 0.15 wt. % of impurities, with the remainder Al. In some examples, the methods can include a third quench to a third temperature.

In some examples, the method of producing an aluminum alloy includes casting a cast aluminum product; homogenizing the cast aluminum product; hot rolling the cast aluminum product to an aluminum alloy body of a first gauge; cold rolling the aluminum alloy body of the first gauge to an aluminum alloy plate, shate or sheet of a second gauge; solutionizing the aluminum alloy plate, shate or sheet; quenching the aluminum alloy plate, shate or sheet, which comprises a first quenching to a first temperature, a second quenching to second temperature and a third quenching to a third temperature; and coiling the aluminum alloy plate, shate or sheet into a coil.

In some non-limiting examples, the quenching step described above can be performed with water, air, or a combination thereof.

In some non-limiting examples, during a multi-step quenching step described herein, the quenching can include quenching to a first temperature that is in a range from approximately 100° C. to approximately 300° C. and subsequently can include quenching to a second temperature that is in a range from approximately 20° C. to approximately 200° C. In some examples, the second temperature can be room temperature (e.g., about 20° C. to about 25° C.). In some cases, the multi-step quenching can include several process steps. In some cases, the multi-step quenching comprises 2 steps, 3 steps, 4 steps, 5 steps, 6 steps, 7 steps, 8 steps, 9 steps, 10 steps or more than 10 steps. In some further cases, the multi-step quenching steps comprise process sub-steps. The multi-step quenching can include any combination of process steps and process sub-steps.

In some examples, the method of producing an aluminum alloy includes casting a cast aluminum product; homogenizing the cast aluminum product; hot rolling the cast aluminum product to an aluminum alloy body of a first gauge; cold rolling the aluminum alloy body of the first gauge to an aluminum alloy plate, shate or sheet of a second gauge; solutionizing the aluminum alloy plate, shate or sheet; quenching the aluminum alloy plate, shate or sheet, which comprises a first quenching to a first temperature, a second quenching to second temperature and a third quenching to a third temperature; flash heating the aluminum alloy plate, shate or sheet and coiling the aluminum alloy plate, shate or sheet into a coil. In some examples, the quenching step can include quenching to room temperature and the flash heating can include heating to about 200° C. for about 10 to 60 seconds. After the flash heating step, the aluminum alloy can be cooled to room temperature and then subjected to additional processing steps, for example, pre-aging or pre-straining.

In some non-limiting examples, the flash heating described above comprises heating the coil to a temperature and maintaining the coil at the temperature for a period of time. The flash heating temperature of the coil can include temperatures in a range of approximately 150° C. to approximately 200° C. The flash heating time at which the coil is maintained can include periods in a range of approximately 5 seconds to approximately 60 seconds.

In some non-limiting examples, the pre-aging described above can further comprise a heat treatment. In some aspects, the heat treatment further increases the strength of the aluminum alloy plate, shate or sheet. The heat treatment comprises heating the aluminum alloy plate, shate or sheet to a temperature of from about 150° C. to about 225° C. for about 10 minutes to about 60 minutes. In some aspects, a pre-straining treatment further increases the strength of the aluminum alloy plate, shate or sheet. The pre-straining comprises straining the aluminum alloy plate, shate or sheet from about 0.5% to about 5%. The heat treatment simulates paint baking. The pre-straining can simulate aluminum alloy part forming.

In some non-limiting examples, employing the method described above, comprising the multi-step quenching and the pre-aging and/or pre-straining, can provide an aluminum alloy plate, shate or sheet having improved yield strength. The provided aluminum alloy plate, shate or sheet is in an exemplary T8x temper.

In some non-limiting examples, the aluminum alloy plate, shate or sheet described above has a yield strength of at least 270 MPa when in T8x temper.

In some non-limiting examples, the methods described herein, including the exemplary quenching and pre-aging steps, can provide an aluminum alloy processing line with improved speed, for example at least 20% faster when compared to comparative aluminum alloy processing methods.

In some non-limiting examples, the aluminum alloy composition combined with the method described above can be used to produce an aluminum alloy product. The aluminum alloy product can be a transportation body part or an electronics device housing.

Further aspects, objects, and advantages of the invention will become apparent upon consideration of the detailed description and figures that follow.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
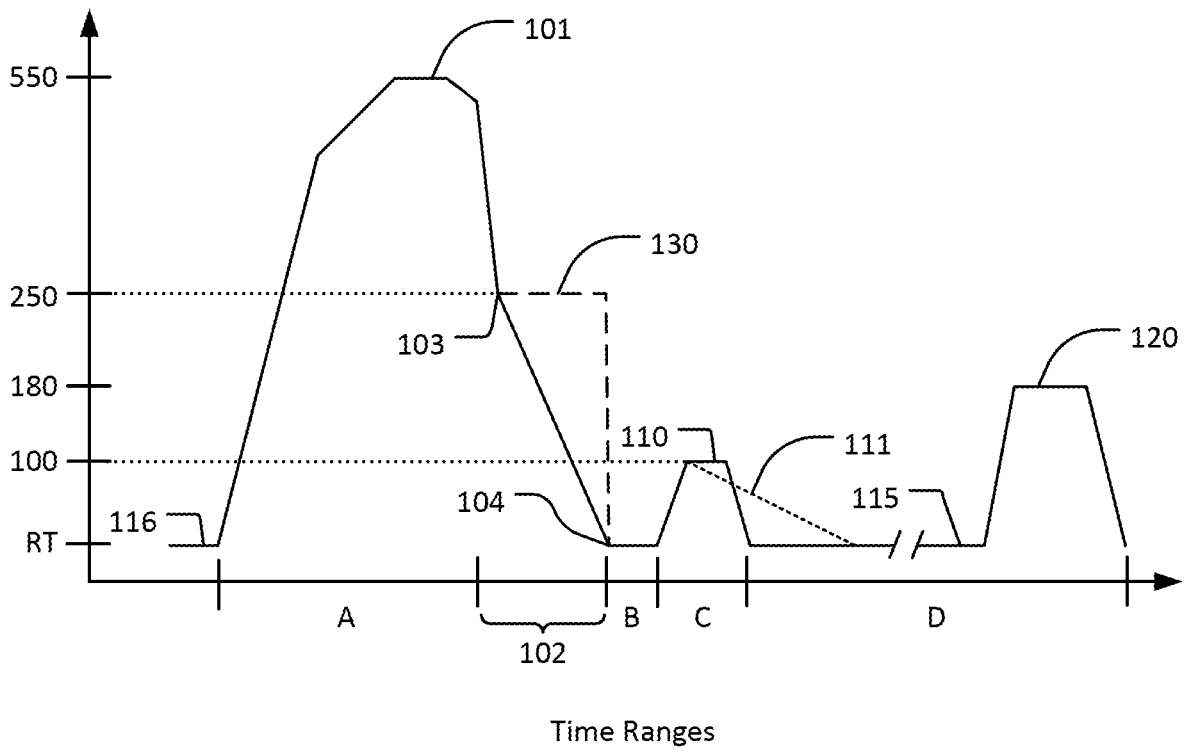
FIG. 1 is a schematic drawing of a process flow for a method described herein.

Certain aspects and features of the present disclosure relate to a quench technique that improves a paint bake response in certain aluminum alloys.

As used herein, the terms "invention," "the invention," "this invention" and "the present invention" are intended to refer broadly to all of the subject matter of this patent application and the claims below. Statements containing these terms should be understood not to limit the subject matter described herein or to limit the meaning or scope of the patent claims below.

In this description, reference is made to alloys identified by AA numbers and other related designations, such as "series." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, the meaning of "a," "an," and "the" includes singular and plural references unless the context clearly dictates otherwise.

As used herein, the meaning of "room temperature" can include a temperature of from about 15° C. to about 30° C., for example about 15° C., about 16° C., about 17° C., about 18° C., about 19° C., about 20° C., about 21° C., about 22° C., about 23° C., about 24° C., about 25° C., about 26° C., about 27° C., about 28° C., about 29° C., or about 30° C.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

Elements are expressed in weight percent (wt. %) throughout this application. The sum of impurities in an alloy may not exceed 0.15 wt. %. The remainder in each alloy is aluminum.

The term T4 temper and the like means an aluminum alloy that has been solutionized and then naturally aged to a substantially stable condition. The T4 temper applies to alloys that are not cold rolled after solutionizing, or in which the effect of cold rolling in flattening or straightening may not be recognized in mechanical property limits.

The term T6 temper refers to an aluminum alloy that has been solution heat treated and artificially aged.

The term T8 temper refers to an aluminum alloy that has been solution heat treated, followed by cold working or rolling, and then artificially aged.

The term F temper refers to an aluminum alloy that is as fabricated.

As used herein, terms such as "cast metal article," "cast article," "cast aluminum product," and the like are interchangeable and refer to a product produced by direct chill casting (including direct chill co-casting) or semi-continuous casting, continuous casting (including, for example, by use of a twin belt caster, a twin roll caster, a block caster, or any other continuous caster), electromagnetic casting, hot top casting, or any other casting method.

Aluminum Alloy Composition

Described below are aluminum alloys. In certain aspects, the alloys exhibit high strength. The properties of the alloys are achieved due to the methods of processing the alloys to produce the described plates, shates, sheets or other products. In some examples, the alloys can have the following elemental composition as provided in Table 1.

TABLE 1

| Alloy Compositions | | | | | | | | | | |
|---|---|---|---|---|---|---|---|---|---|---|
| Alloy | Si | Fe | Cu | Mn | Mg | Cr | Ni | Zn | Ti | V |
| C1 | 0.5-1.3 | 0.1-0.3 | 0.0-0.4 | 0.02-0.2 | 0.5-1.3 | 0.0-0.25 | 0.0-0.01 | 0.0-0.1 | 0.0-0.1 | 0.0-0.1 |
| A1 | 0.5-1.0 | 0.1-0.3 | 0.5-1.0 | 0.0-0.2 | 0.8-1.0 | 0.0-0.3 | 0.0-0.05 | 0.0-0.1 | 0.0-0.05 | 0.0-0.05 |
| B1 | 0.8-1.0 | 0.0-0.3 | 0.7-0.9 | 0.0-0.2 | 0.8-1.0 | 0.0-0.3 | 0.0-0.05 | 0.0-0.05 | 0.0-0.05 | 0.0-0.05 |
| G1 | 1.0-1.5 | 0.0-0.5 | 1.0-1.5 | 0.0-0.5 | 1.0-1.5 | 0.1-0.5 | 0.0-0.05 | 0.0-0.1 | 0.0-0.05 | 0.0-0.05 |

All values are weight percent (wt. %) of the whole.

In certain examples, the alloy includes silicon (Si) in an amount from about 0.45% to about 1.5% (e.g., from 0.5% to 1.1%, from 0.55% to 1.25%, from 0.6% to 1.0%, from 1.0% to 1.3%, or from 1.03 to 1.24%) based on the total weight of the alloy. For example, the alloy can include 0.45%, 0.46%, 0.47%, 0.48%, 0.49%, 0.5%, 0.51%, 0.52%, 0.53%, 0.54%, 0.55%, 0.56%, 0.57%, 0.58%, 0.59%, 0.6%, 0.61%, 0.62%, 0.63%, 0.64%, 0.65%, 0.66%, 0.67%, 0.68%, 0.69%, 0.7%, 0.71%, 0.72%, 0.73%, 0.74%, 0.75%, 0.76%, 0.77%, 0.78%, 0.79%, 0.8%, 0.81%, 0.82%, 0.83%, 0.84%, 0.85%, 0.86%, 0.87%, 0.88%, 0.89%, 0.9%, 0.91%, 0.92%, 0.93%, 0.94%, 0.95%, 0.96%, 0.97%, 0.98%, 0.99%, 1.0%, 1.01%, 1.02%, 1.03%, 1.04%, 1.05%, 1.06%, 1.07%, 1.08%, 1.09%, 1.1%, 1.11%, 1.12%, 1.13%, 1.14%, 1.15%, 1.16%, 1.17%, 1.18%, 1.19%, 1.2%, 1.21%, 1.22%, 1.23%, 1.24%, 1.25%, 1.26%, 1.27%, 1.28%, 1.29%, 1.3%, 1.31%, 1.32%, 1.33%, 1.34%, 1.35%, 1.36%, 1.37%, 1.38%, 1.39%, 1.4%, 1.41%, 1.42%, 1.43%, 1.44%, 1.45%, 1.46%, 1.47%, 1.48%, 1.49%, or 1.5% Si. All expressed in wt. %.

In certain examples, the alloy includes iron (Fe) in an amount from about 0.1% to about 0.5% (e.g., from 0.15% to 0.25%, from 0.14% to 0.26%, from 0.13% to 0.27%, or from 0.12% to 0.28%) based on the total weight of the alloy. For example, the alloy can include 0.1%, 0.11%, 0.12%, 0.13%, 0.14%, 0.15%, 0.16%, 0.17%, 0.18%, 0.19%, 0.2%, 0.21%, 0.22%, 0.23%, 0.24%, 0.25%, 0.26%, 0.27%, 0.28%, 0.29%, 0.3%, 0.31%, 0.32%, 0.33%, 0.34%, 0.35%, 0.36%, 0.37%, 0.38%, 0.39%, 0.4%, 0.41%, 0.42%, 0.43%, 0.44%, 0.45%, 0.46%, 0.47%, 0.48%, 0.49%, or 0.5% Fe. All expressed in wt. %.

In certain examples, the alloy includes copper (Cu) in an amount from about 0.0% to about 1.5% (e.g., from 0.1 to 0.2%, from 0.3 to 0.4%, from 0.05% to 0.25%, from 0.04% to 0.34%, or from 0.15% to 0.35%) based on the total weight of the alloy. For example, the alloy can include 0.01%, 0.02%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, 0.2%, 0.21%, 0.22%, 0.23%, 0.24%, 0.25%, 0.26%, 0.27%, 0.28%, 0.29%, 0.3%, 0.31%, 0.32%, 0.33%, 0.34%, or 0.35%, 0.36%, 0.37%, 0.38%, 0.39%, 0.4%, 0.41%, 0.42%, 0.43%, 0.44%, 0.45%, 0.46%, 0.47%, 0.48%, 0.49%, 0.5%, 0.51%, 0.52%, 0.53%, 0.54%, 0.55%, 0.56%, 0.57%, 0.58%, 0.59%, 0.6%, 0.61%, 0.62%, 0.63%, 0.64%, 0.65%, 0.66%, 0.67%, 0.68%, 0.69%, 0.7%, 0.71%, 0.72%, 0.73%, 0.74%, 0.75%, 0.76%, 0.77%, 0.78%, 0.79%, 0.8%, 0.81%, 0.82%, 0.83%, 0.84%, 0.85%, 0.86%, 0.87%, 0.88%, 0.89%, 0.9%, 0.91%, 0.92%, 0.93%, 0.94%, 0.95%, 0.96%, 0.97%, 0.98%, 0.99%, 1.0%, 1.01%, 1.02%, 1.03%, 1.04%, 1.05%, 1.06%, 1.07%, 1.08%, 1.09%, 1.1%, 1.11%, 1.12%, 1.13%, 1.14%, 1.15%, 1.16%, 1.17%, 1.18%, 1.19%, 1.2%, 1.21%, 1.22%, 1.23%, 1.24%, 1.25%, 1.26%, 1.27%, 1.28%, 1.29%, 1.3%, 1.31%, 1.32%, 1.33%, 1.34%, 1.35%, 1.36%, 1.37%, 1.38%, 1.39%, 1.4%, 1.41%, 1.42%, 1.43%, 1.44%, 1.45%, 1.46%, 1.47%, 1.48%, 1.49%, or 1.5% Cu. In some cases, Cu is not present in the alloy (i.e., 0%). All expressed in wt. %.

Cu can be included in an aluminum alloy to increase strength and hardness after solutionizing and optional aging. Higher amounts of Cu included in an aluminum alloy can significantly decrease formability after solutionizing and optional aging. In some non-limiting examples, aluminum alloys with low amounts of Cu can provide increased strength and good formability when produced via exemplary methods described herein.

In certain examples, the alloy can include manganese (Mn) in an amount from about 0.02% to about 0.5% (e.g., from 0.02% to 0.14%, from 0.025% to 0.175%, about 0.03%, from 0.11% to 0.19%, from 0.08% to 0.12%, from 0.12% to 0.18%, from 0.09% to 0.18%, and from 0.02% to 0.06%) based on the total weight of the alloy. For example, the alloy can include 0.02%, 0.021%, 0.022%, 0.023%, 0.024%, 0.025%, 0.026%, 0.027%, 0.028%, 0.029%, 0.03%, 0.031%, 0.032%, 0.033%, 0.034%, 0.035%, 0.036%, 0.037%, 0.038%, 0.039%, 0.04%, 0.041%, 0.042%, 0.043%, 0.044%, 0.045%, 0.046%, 0.047%, 0.048%, 0.049%, 0.05%, 0.051%, 0.052%, 0.053%, 0.054%, 0.055%, 0.056%, 0.057%, 0.058%, 0.059%, 0.06%, 0.061%, 0.062%, 0.063%, 0.064%, 0.065%, 0.066%, 0.067%, 0.068%, 0.069%, 0.07%, 0.071%, 0.072%, 0.073%, 0.074%, 0.075%, 0.076%, 0.077%, 0.078%, 0.079%, 0.08%, 0.081%, 0.082%, 0.083%, 0.084%, 0.085%, 0.086%, 0.087%, 0.088%, 0.089%, 0.09%, 0.091%, 0.092%, 0.093%, 0.094%, 0.095%, 0.096%, 0.097%, 0.098%, 0.099%, 0.1%, 0.11%, 0.12%, 0.13%, 0.14%, 0.15%, 0.16%, 0.17%, 0.18%, 0.19%, 0.2%, 0.21%, 0.22%, 0.23%, 0.24%, 0.25%, 0.26%, 0.27%, 0.28%, 0.29%, 0.3%, 0.31%, 0.32%, 0.33%, 0.34%, 0.35%, 0.36%, 0.37%, 0.38%, 0.39%, 0.4%, 0.41%, 0.42%, 0.43%, 0.44%, 0.45%, 0.46%, 0.47%, 0.48%, 0.49%, or 0.5% Mn. All expressed in wt. %.

In certain examples, the alloy includes magnesium (Mg) in an amount from about 0.45% to about 1.5% (e.g., from about 0.6% to about 1.3%, about 0.65% to 1.2%, from 0.8% to 1.2%, or from 0.9% to 1.1%) based on the total weight of the alloy. For example, the alloy can include 0.45%, 0.46%, 0.47%, 0.48%, 0.49%, 0.5%, 0.51%, 0.52%, 0.53%, 0.54%, 0.55%, 0.56%, 0.57%, 0.58%, 0.59%, 0.6%, 0.61%, 0.62%, 0.63%, 0.64%, 0.65%, 0.66%, 0.67%, 0.68%, 0.69%, 0.7%, 0.71%, 0.72%, 0.73%, 0.74%, 0.75%, 0.76%, 0.77%, 0.78%, 0.79%, 0.8%, 0.81%, 0.82%, 0.83%, 0.84%, 0.85%, 0.86%, 0.87%, 0.88%, 0.89%, 0.9%, 0.91%, 0.92%, 0.93%, 0.94%, 0.95%, 0.96%, 0.97%, 0.98%, 0.99%, 1.0%, 1.01%, 1.02%, 1.03%, 1.04%, 1.05%, 1.06%, 1.07%, 1.08%, 1.09%, 1.1%, 1.11%, 1.12%, 1.13%, 1.14%, 1.15%, 1.16%, 1.17%, 1.18%, 1.19%, 1.2%, 1.21%, 1.22%, 1.23%, 1.24%, 1.25%, 1.26%, 1.27%, 1.28%, 1.29%, 1.3%, 1.31%, 1.32%, 1.33%, 1.34%, 1.35%, 1.36%, 1.37%, 1.38%, 1.39%, 1.4%, 1.41%, 1.42%, 1.43%, 1.44%, 1.45%, 1.46%, 1.47%, 1.48%, 1.49%, or 1.5% Mg. All expressed in wt. %.

In certain examples, the alloy includes chromium (Cr) in an amount of up to about 0.5% (e.g., from 0.001% to 0.15%, from 0.001% to 0.13%, from 0.005% to 0.12%, from 0.02% to 0.04%, from 0.08% to 0.25%, from 0.03% to 0.045%, from 0.01% to 0.06%, from 0.035% to 0.045%, from 0.004% to 0.08%, from 0.06% to 0.13%, from 0.06% to 0.18%, from 0.1% to 0.13%, or from 0.11% to 0.12%) based on the total weight of the alloy. For example, the alloy can include 0.001%, 0.002%, 0.003%, 0.004%, 0.005%, 0.006%, 0.007%, 0.008%, 0.009%, 0.01%, 0.011%, 0.012%, 0.013%, 0.014%, 0.015%, 0.02%, 0.025%, 0.03%, 0.035%, 0.04%, 0.045%, 0.05%, 0.055%, 0.06%, 0.065%, 0.07%, 0.075%, 0.08%, 0.085%, 0.09%, 0.095%, 0.1%, 0.105%, 0.11%, 0.115%, 0.12%, 0.125%, 0.13%, 0.135%, 0.14%, 0.145%, 0.15%, 0.155%, 0.16%, 0.165%, 0.17%, 0.175%, 0.18%, 0.185%, 0.19%, 0.195%, 0.2%, 0.205%, 0.21%, 0.215%, 0.22%, 0.225%, 0.23%, 0.235%, 0.24%, 0.245%, 0.25%, 0.255%, 0.26%, 0.265%, 0.27%, 0.275%, 0.28%, 0.285%, 0.29%, 0.295%, 0.3%, 0.305%, 0.31%, 0.315%, 0.32%, 0.325%, 0.33%, 0.335%, 0.34%, 0.345%, 0.35%, 0.355%, 0.36%, 0.365%, 0.37%, 0.375%, 0.38%, 0.385%, 0.39%, 0.395%, 0.4%, 0.405%, 0.41%, 0.415%, 0.42%, 0.425%, 0.43%, 0.435%, 0.44%, 0.445%, 0.45%, 0.455%, 0.46%, 0.465%, 0.47%, 0.475%, 0.48%, 0.485%, 0.49%, 0.495%, or 0.5% Cr. In certain aspects, Cr is not present in the alloy (i.e., 0%). All expressed in wt. %.

In certain examples, the alloy includes nickel (Ni) in an amount up to about 0.01% (e.g., from 0.001% to 0.01%) based on the total weight of the alloy. For example, the alloy can include 0.001%, 0.002%, 0.003%, 0.004%, 0.005%, 0.006%, 0.007%, 0.008%, 0.009%, 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.031%, 0.032%, 0.033%, 0.034%, 0.035%, 0.036%, 0.037%, 0.038%, 0.039%, 0.04%, 0.041%, 0.042%, 0.043%, 0.044%, 0.045%, 0.046%, 0.047%, 0.048%, 0.049%, or 0.05% Ni. In certain aspects, Ni is not present in the alloy (i.e., 0%). All expressed in wt. %.

In certain examples, the alloy includes zinc (Zn) in an amount up to about 0.1% (e.g., from 0.001% to 0.09%, from 0.004% to 0.1%, or from 0.06% to 0.1%) based on the total weight of the alloy. For example, the alloy can include 0.001%, 0.002%, 0.003%, 0.004%, 0.005%, 0.006%, 0.007%, 0.008%, 0.009%, 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.04%, 0.05%, 0.06%, 0.07%, 0.08%, 0.09%, or 0.1% Zn. In certain cases, Zn is not present in the alloy (i.e., 0%). All expressed in wt. %.

In certain examples, the alloy includes titanium (Ti) in an amount up to about 0.1% (e.g., from 0.01% to 0.1%) based on the total weight of the alloy. For example, the alloy can include 0.001%, 0.002%, 0.003%, 0.004%, 0.005%, 0.006%, 0.007%, 0.008%, 0.009%, 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.031%, 0.032%, 0.033%, 0.034%, 0.035%, 0.036%, 0.037%, 0.038%, 0.039%, 0.04%, 0.05%, 0.051%, 0.052%, 0.053%, 0.054%, 0.055%, 0.056%, 0.057%, 0.058%, 0.059%, 0.06%, 0.07%, 0.08%, 0.09%, or 0.1% Ti. All expressed in wt. %.

In certain examples, the alloy includes vanadium (V) in an amount up to about 0.1% (e.g., from 0.01% to 0.1%,) based on the total weight of the alloy. For example, the alloy can include 0.001%, 0.002%, 0.003%, 0.004%, 0.005%, 0.006%, 0.007%, 0.008%, 0.009%, 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.031%, 0.032%, 0.033%, 0.034%, 0.035%, 0.036%, 0.037%, 0.038%, 0.039%, 0.04%, 0.05%, 0.051%, 0.052%, 0.053%, 0.054%, 0.055%, 0.056%, 0.057%, 0.058%, 0.059%, 0.06%, 0.07%, 0.08%, 0.09%, or 0.1% V. All expressed in wt. %.

Optionally, the alloy compositions described herein can further include other minor elements, sometimes referred to as impurities, in amounts of about 0.05% or below, 0.04% or below, 0.03% or below, 0.02% or below, or 0.01% or below each. These impurities may include, but are not limited to, Ga, Ca, Hf, Sr, Sc, Sn, Zr or combinations thereof. Accordingly, Ga, Ca, Hf, Sr, Sc, Sn or Zr may be present in an alloy in amounts of 0.05% or below, 0.04% or below, 0.03% or below, 0.02% or below, or 0.01% or below. In certain examples, the sum of all impurities does not exceed about 0.15% (e.g., 0.1%). All expressed in wt. %. In certain examples, the remaining percentage of the alloy is aluminum.

Methods of Making

An exemplary thermal history is presented in FIG. 1. A cold rolled exemplary aluminum alloy (e.g., Alloy Cl, see Table 1) is subjected to a solutionizing step to evenly distribute alloying elements throughout the aluminum matrix. The solutionizing step can include heating the rolled Alloy Cl to above a solutionizing temperature 101 sufficient to soften the aluminum without melting and maintaining the alloy above the solutionizing temperature 101. The solutionizing step can be performed for a period of time of about 1 to about 5 minutes (Range A). Solutionizing can allow the alloying elements to diffuse throughout and distribute evenly within the alloy. Once solutionized, the aluminum alloy is rapidly cooled (i.e., quenched) 102 to freeze the alloying elements in place and prevent the alloying elements from agglomerating and precipitating out of the aluminum matrix. In the example shown in FIG. 1, the quenching is discontinuous.

In some examples, a discontinuous quenching step can include quenching to a first temperature 103 via a first method and subsequently quenching to a second temperature 104 via a second method. In some examples, a third quenching to a third temperature can be included. In some non-limiting examples, the first quenching temperature 103 can be from approximately 150° C. to approximately 300° C. (e.g., about 250° C.). In some cases, the first quenching step can be performed with water. In some non-limiting examples, the second quenching temperature 104 can be room temperature ("RT") (e.g., about 20° C. to about 25° C., including 20° C., 21° C., 22° C., 23° C., 24° C., or 25° C.). In some examples, the second quenching step can be performed with air.

In some examples, a discontinuous quenching step can include quenching to a first temperature 103 via a first method and subsequently quenching to a second temperature 104 via a second method. In some examples, the first method includes quenching in a salt bath. In some examples, the second method includes quenching with air or water. In some examples, the discontinuous quenching step can further include a third quenching to a third temperature.

In some further examples, a heat treatment step (i.e., flash heating) 130 is included. In some cases, the flash heating (FX) step includes maintaining the first temperature 103 in the salt bath for a period of time from about 10 seconds to about 60 seconds. The alloy can be further quenched to the second temperature after the FX step. After the flash heating step and further quenching step, the coil can be cooled to room temperature and then subjected to additional processing steps, for example, pre-aging or other steps.

In some further examples, the flash heating step is performed independent of a quenching step. The flash heating step includes heating the aluminum alloy from the second temperature 104 to a FX temperature of from about 180° C. to about 250° C. and maintaining the FX temperature for about 10 seconds to about 60 seconds (not shown). In some cases, the quenching step is continuous. In some further examples, the quenching step can be performed with air. In some other cases the quenching step can be performed with water. In some non-limiting examples the quenching step is discontinuous as described herein. After the flash heating step, the coil can be cooled to room temperature and then subjected to additional processing steps, for example, pre-aging or other steps.

In some non-limiting examples, the solutionized and quenched Alloy Cl can be then subjected to an aging procedure after the quenching step. In some examples the aging step is performed from about 1 minute to about 20 minutes (Range B) after the quenching step. In some non-limiting examples, the aging procedure comprises a pre-aging step 110 (laboratory setting) or 111 (manufacturing setting) and a paint bake step 120. The pre-aging step 110 can be performed for about 1 hour to about 4 hours (Range C). In some non-limiting examples, the pre-aging step 110 can provide an aluminum alloy in a T4 temper. The pre-aging step 110 can be a preliminary thermal treatment that does not significantly affect mechanical properties of the aluminum alloy, but rather the pre-aging step 110 can partially age the aluminum alloy such that further downstream thermal treatment can complete an artificial aging process. For example, employing a pre-aging step, a deforming step and a paint bake step is an artificial aging process resulting in a T8x temper condition in a cold rolled aluminum alloy. In some examples, the T8x temper is indicated by amount of deformation, thermal treatment temperature and period of time thermally treated (e.g., 2%+170° C.—20 min). Pre-aging in a manufacturing setting 111 can comprise heating to a pre-aging temperature and cooling for a time period that can be greater than 24 hours. In some examples, the alloy is not subjected to a paint bake step resulting in a T4 temper condition 115. In some cases, the paint bake step is performed by an end user. In some further examples, the alloy is not thermally treated at all resulting in an F temper condition 116. In some examples, the aging process can increase the strength of the aluminum alloy (i.e., bake hardening). Normally, a strength increase by aging provides an aluminum alloy having poor formability, as the increased strength can be a result of hardening of the aluminum alloy. The entire aging process can be performed for about 1 week to about 6 months (Range D).

In some non-limiting examples, the discontinuous quenching technique provides a greater bake hardening compared to aluminum alloys fully quenched to room temperature after solutionizing via a continuous process.

In some additional examples, a heat treatment step (i.e., flash heating) can be included. In some cases, once solutionized, the aluminum alloy can be quenched to room temperature. The quenched alloy can be then reheated to a second temperature for a period of time. In some such examples, the second temperature can be between about 180° C. to about 250° C., for example, 200° C., and the second temperature can be maintained for a period of about 10 to 60 seconds. The alloy can then be cooled to room temperature by a second quench step. In some examples, the second quenching step can be performed with air. In some examples, the second quenching step can be performed with water. In some examples, the flash heating can be carried out less than about 20 minutes after the alloy is quenched to room temperature, for example, after about being maintained at room temperature for about 10 minutes, 9 minutes, 8 minutes, 7 minutes, 6 minutes, 5 minutes, 4 minutes, 3 minutes, 2 minutes, or 1 minute.

In some non-limiting examples, aging can be performed. In some examples, the aluminum alloy plate, shate or sheet can be coated. In some further examples, the aluminum alloy plate, shate or sheet can be thermally treated. In some still further examples, the thermal treatment can further age the aluminum alloy plate, shate or sheet.

The following illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may not be drawn to scale.

EXAMPLES

Example 1

Figure 2:
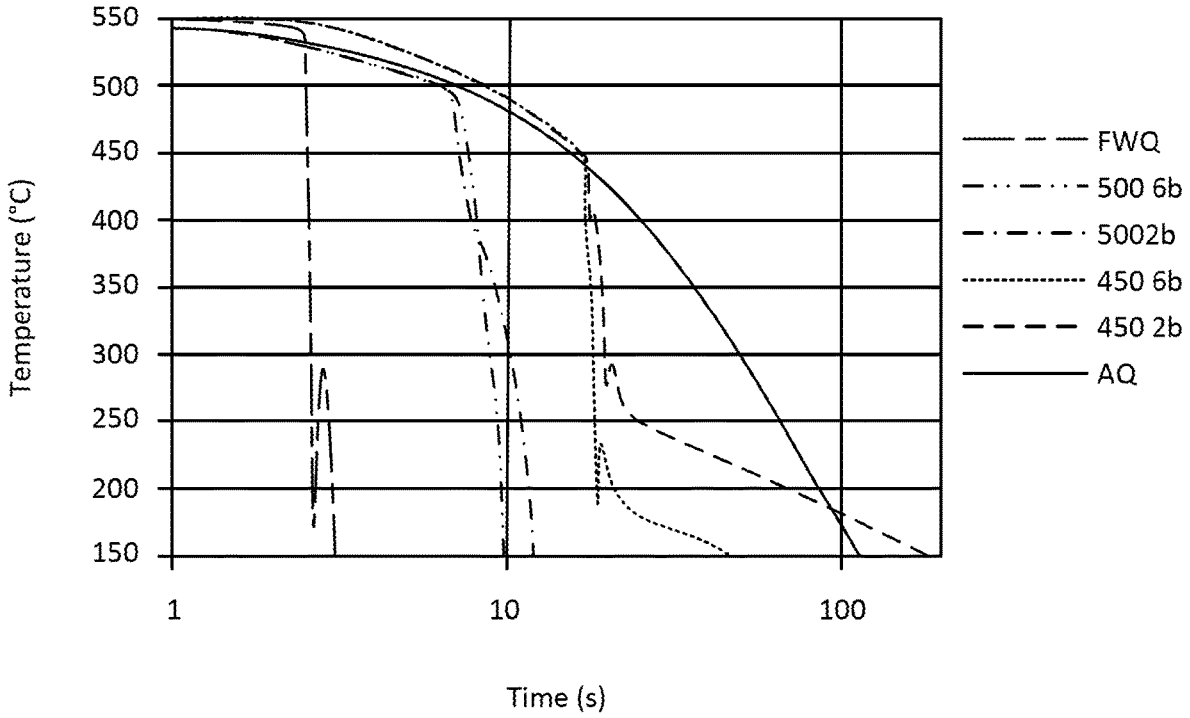
FIG. 2 is a graph showing thermal histories over time of an exemplary alloy described herein.

FIG. 2 is a graph of thermal histories of Alloy Cl during an exemplary quenching technique and a comparative continuous quenching technique. A continuous full water quench (FWQ) and continuous air-only quench (AQ) are shown for comparison. The discontinuous exemplary method is started at various Alloy Cl coil temperatures including 500° C. and 450° C. upon exit from the solutionizing furnace. The water quenching was performed at various water spray pressures including 6 bar (b) and 2 bar (b). The graph details a rapid cooling of the FWQ and a slower cooling of the AQ. The Alloy Cl quenched via the exemplary discontinuous quench, beginning when the alloy exited the solutionizing furnace, was cooled to 500° C. via an air quench upon (referred to as "500 6b" and "500 2b"), showed a rapid cooling of the alloy without a second slower quench step. The Alloy Cl samples quenched via the exemplary discontinuous quench, showed a discontinuity when the quenching was changed from being performed with water to being performed with air at approximately 250° C. The alloy temperature was 540° C. upon exit from the solutionizing furnace, quenched with air to a temperature of about 450° C. then quenched with water to a temperature of about 250° C., then quenched with air to about room temperature (referred to as "450 6b" and "450 2b").

Figure 3:
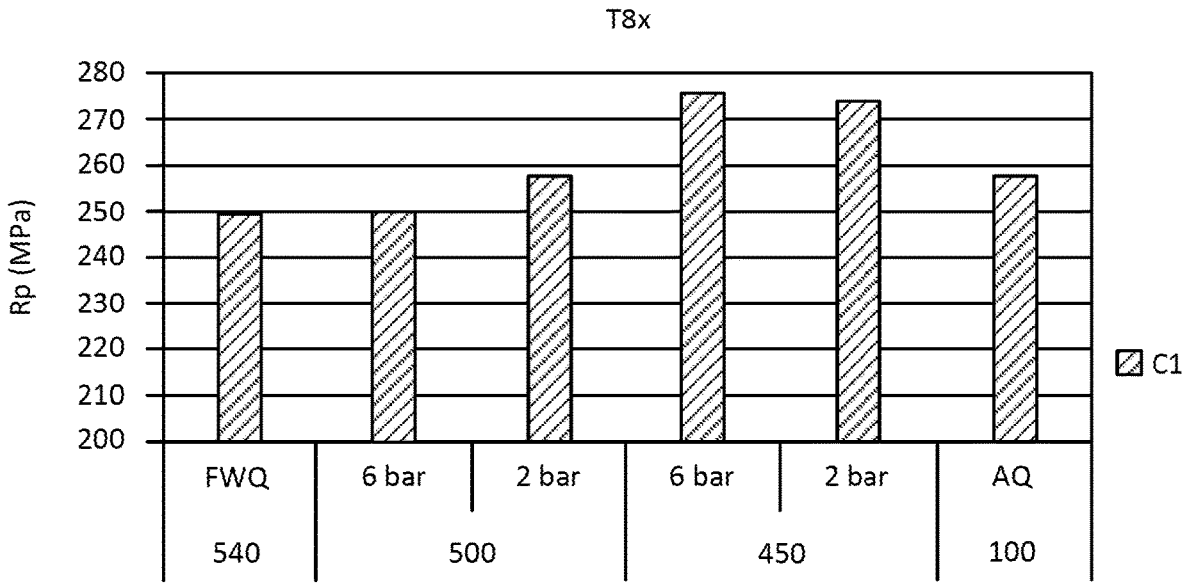
FIG. 3 is a bar chart showing yield strength of samples taken from an exemplary alloy in T8x temper described herein.

FIG. 3 shows the yield strength test results of the Alloy Cl samples described above after an optional artificial aging process described above was employed. Shown in the graph is the increase in yield strength of Alloy Cl subjected to the exemplary discontinuous quenching that begins with a first quenching by water when the solutionized coil exited the solutionizing furnace and then changes to a second quenching by air when the coil was cooled to approximately 250° C. The exemplary alloy subjected to the exemplary quenching and optional deformation and aging results in an exemplary T8x temper.

Figure 4:
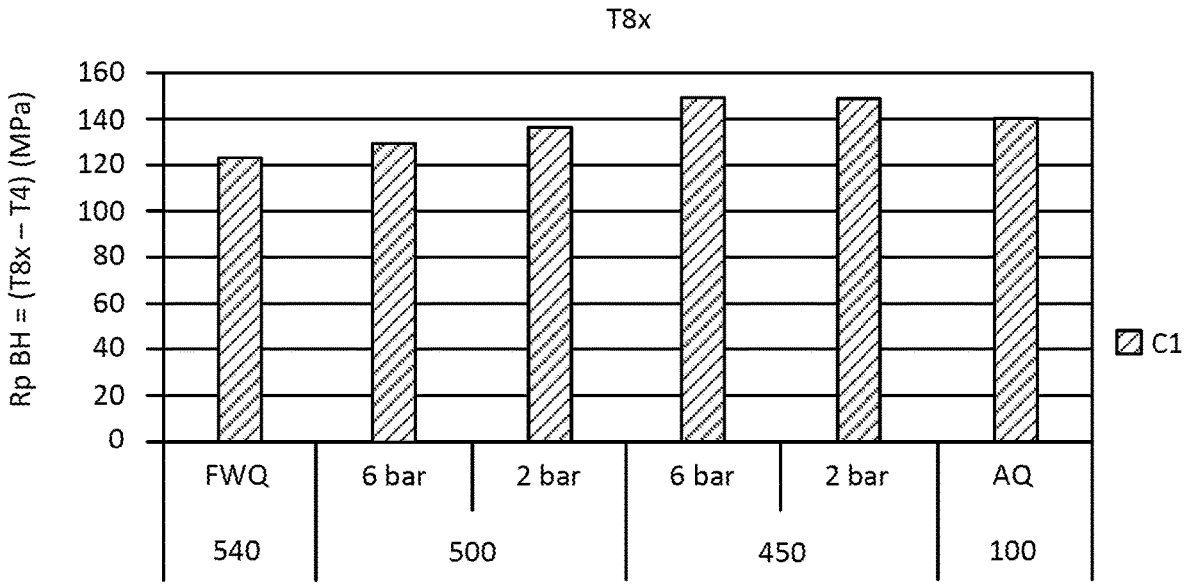
FIG. 4 is a bar chart showing a bake hardening response (i.e., increase in yield strength) of samples taken from an exemplary alloy described herein.

FIG. 4 presents the difference in yield strength of the exemplary Alloy Cl samples in the exemplary T8x temper and comparative Alloy Cl samples in T4 temper. The comparative Alloy Cl samples were subjected to natural aging resulting in a T4 temper condition. The bake hardening (BH) response indicated on the y-axis is a result of subtracting the recorded yield strength of Alloy Cl in the comparative T4 temper from the recorded yield strength of Alloy Cl in the exemplary T8x temper. Evident in the graph is the greater increase in yield strength of Alloy Cl subjected to the exemplary discontinuous quenching as compared to the yield strength of the comparative Alloy Cl subjected to a full water quench (FWQ) or an air quench (AQ) as the sole quenching procedure.

Figure 5:
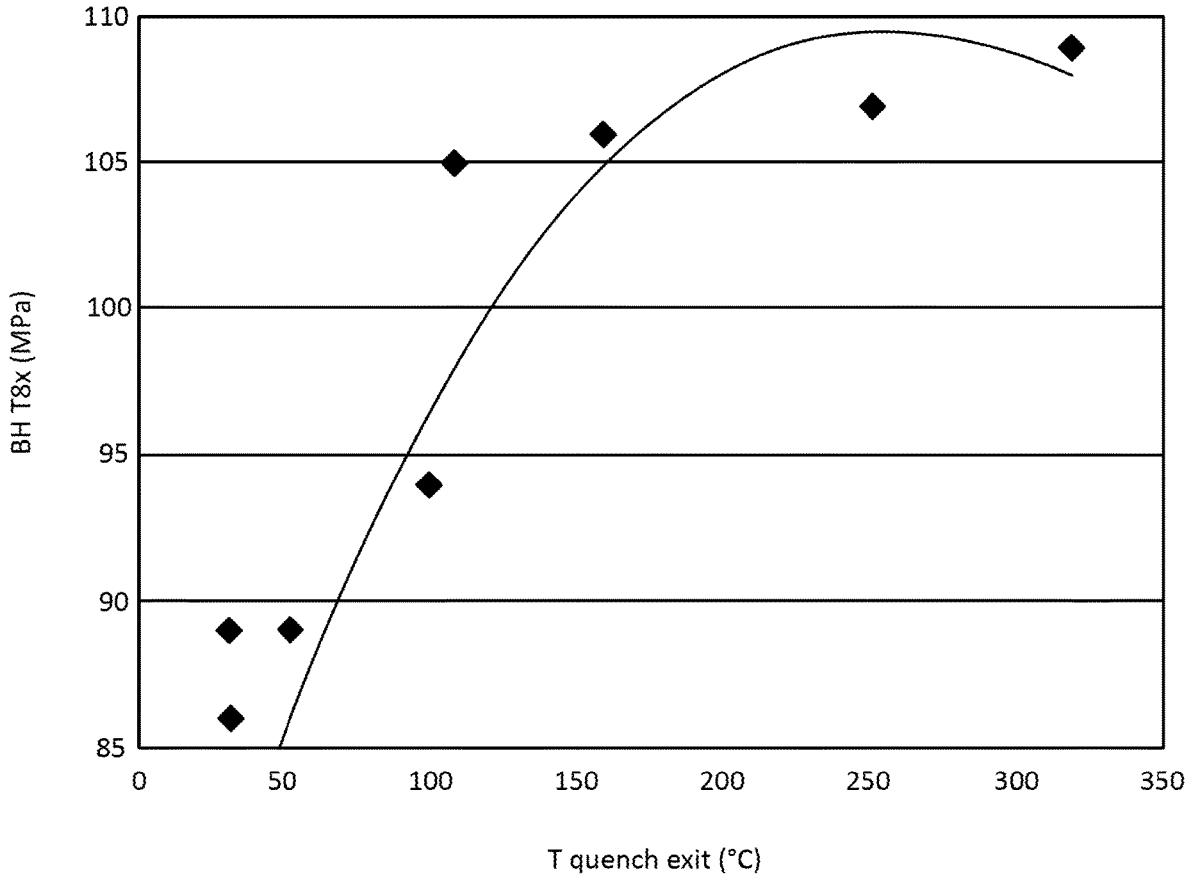
FIG. 5 is a graph showing a bake hardening response as a function of temperature of an exemplary alloy described herein after exiting a first quenching step described herein.

FIG. 5 presents the results of exemplary Alloy Cl subjected to the exemplary discontinuous quenching technique, where the quenching method was changed at various temperatures. Exemplary Alloy Cl was not subjected to the optional pre-aging step. Exemplary Alloy Cl shown in FIG. 5 was subjected to the optional paint bake step. Shown in the graph is an optimal temperature for a discontinuity point in the exemplary quenching technique of approximately 250° C. (i.e., the quench was changed from water to air at about 250° C.).

Example 2

Figure 6:
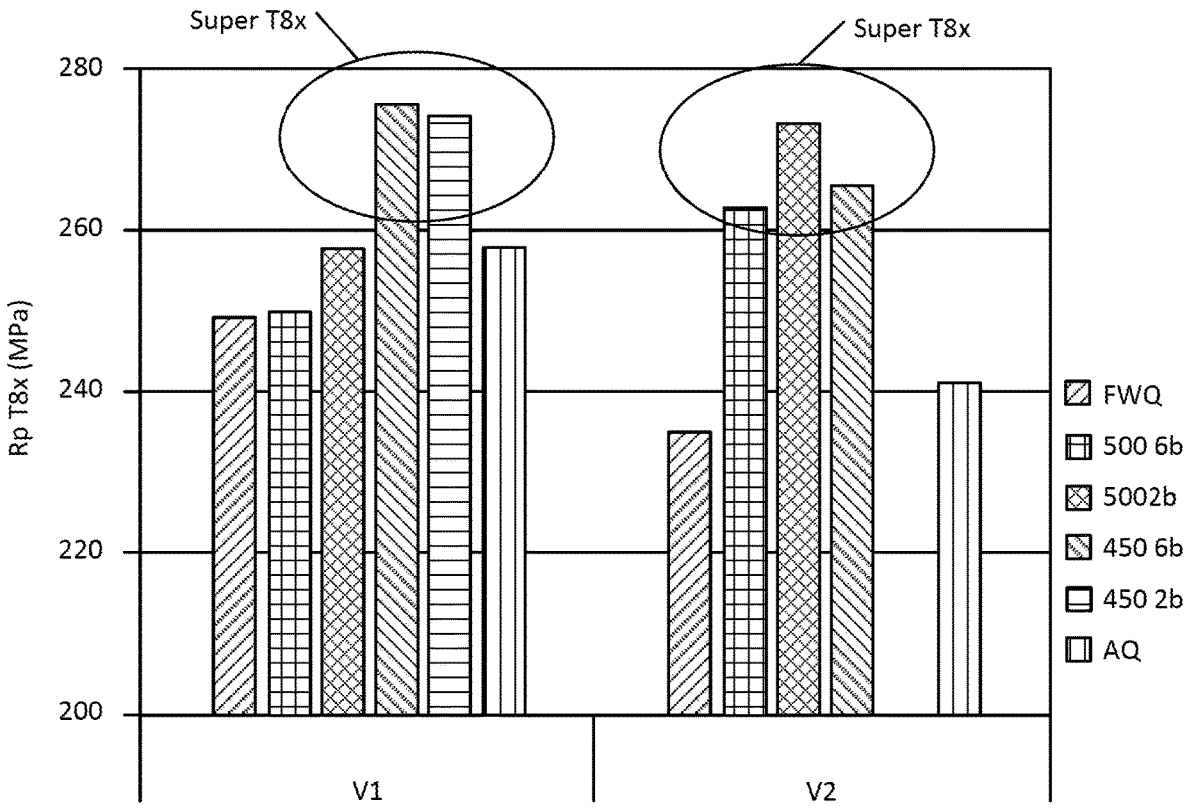
FIG. 6 is a bar chart showing yield strength of samples taken from an alloy described herein subjected to various methods of making described herein.

FIG. 6 presents the yield strength test results of the exemplary quenching deformation and paint baking techniques employed during processing of an exemplary aluminum alloy with various Mn content. Exemplary aluminum alloys V1 and V2 compositions in this example are described in Table 2 (with the balance of components being consistent with the examples described herein):

TABLE 2

Exemplary Alloy Compositions

| Alloy | Si | Fe | Cu | Mn | Mg |
|---|---|---|---|---|---|
| V1 | 0.85 | 0.20 | 0.08 | 0.07 | 0.65 |
| V2 | 0.85 | 0.20 | 0.08 | 0.20 | 0.65 |

FIG. 6 shows an increase in yield strength of exemplary Alloy V1 and exemplary Alloy V2 subjected to the exemplary discontinuous quenching, beginning the air quench when the solutionized coil exited the solutionizing furnace and changing to a water quench to a temperature of about 450° C. and then changing to an air quench when the coil was cooled to approximately 250° C. The alloy subjected to the exemplary quenching, deformation and aging (2% strain then heating to 185° C. and maintaining 185° C. for 20 minutes) results in an exemplary T8x temper. In FIG. 6, the first histogram bar in each group of bars shows the yield strength of a sample that was subjected to a continuous full water quench (FWQ); the second histogram bar in each group shows the yield strength of a sample quenched via the exemplary discontinuous quench, beginning when the alloy exited the solutionizing furnace and the temperature reached 500° C., conducted with a water spray pressure of 6 bar; the third histogram bar in each group shows the yield strength of a sample quenched via the exemplary discontinuous quench, beginning when the alloy exited the solutionizing furnace and the temperature reached 500° C., conducted with a water spray pressure of 2 bar; the fourth histogram bar in each group shows the yield strength of a sample quenched via the exemplary discontinuous quench, beginning when the alloy exited the solutionizing furnace and the temperature reached 450° C., conducted with a water spray pressure of 6 bar; the fifth histogram bar in each group (the fifth bar of the second group is not included in FIG. 6) shows the yield strength of a sample quenched via the exemplary discontinuous quench, beginning when the alloy exited the solutionizing furnace and the temperature reached 450° C., conducted with a water spray pressure of 2 bar; and the sixth histogram bar in each group of bars shows the yield strength of a sample that was subjected to a continuous air-only quench.

Figure 7:
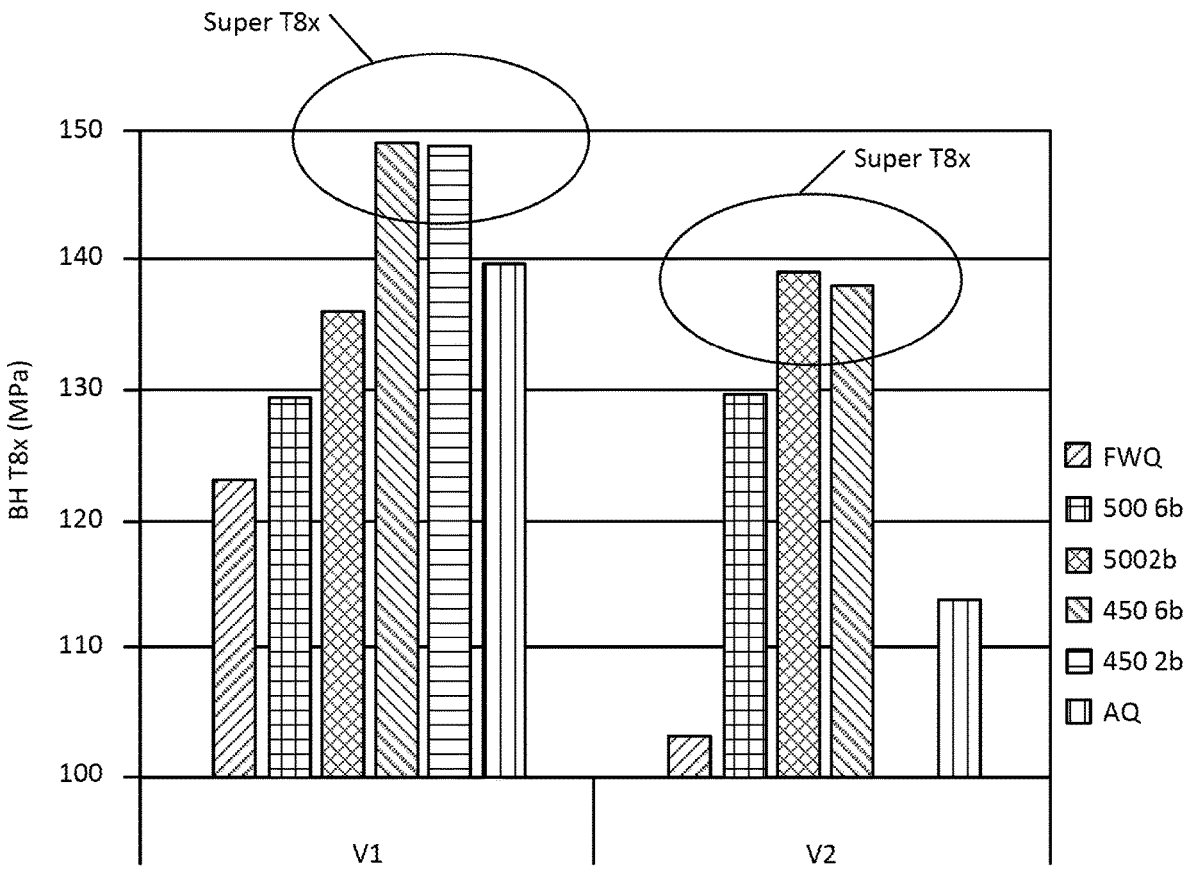
FIG. 7 is a bar chart showing a bake hardening response (i.e., increase in yield strength) of samples taken from an alloy described herein subjected to various methods of making described herein.

Also shown in FIG. 6 is the effect of increasing Mn content in the exemplary Alloy V1 composition. The exemplary T8x temper is achievable when the exemplary quench begins with quenching the Alloy V1 coil to a temperature of 450° C. or 500° C. with air, changing to water and quenching to 250° C. and then quenching with air to room temperature. FIG. 7 presents the difference in yield strength of the exemplary Alloys V1 and V2 samples in the exemplary T8x temper and comparative T4 temper. The bake hardening (BH) response indicated on the y-axis is a result of subtracting the recorded yield strength of Alloys V1 and V2 in T4 temper from the recorded yield strength of Alloys V1 and V2 in the exemplary T8x temper. Shown in FIG. 7 is the greater increase in yield strength of Alloys V1 and V2 subjected to the exemplary discontinuous quenching, beginning the water quench when the solutionized coil exited the solutionizing furnace and cooled to 450° C. or 500° C. and changing to the air quench when the coil was cooled to approximately 250° C. Also evident is the effect of increasing Mn content in the exemplary Alloy V1 composition. In FIG. 7, the first histogram bar in each group of bars shows the yield strength of a sample that was subjected to a continuous full water quench (FWQ); the second histogram bar in each group shows the yield strength of a sample quenched via the exemplary discontinuous quench, beginning when the alloy exited the solutionizing furnace and was quenched with air unit the temperature reached 500° C., quenched with a water spray (pressure of 6 bar) to 250° C. then quenched with air to room temperature; the third histogram bar in each group shows the yield strength of a sample quenched via the exemplary discontinuous quench, beginning when the alloy exited the solutionizing furnace and was quenched with air until the temperature reached 500° C., quenched with a water spray (pressure of 2 bar) to 250° C. then quenched with air to room temperature; the fourth histogram bar in each group shows the yield strength of a sample quenched via the exemplary discontinuous quench, beginning when the alloy exited the solutionizing furnace and was quenched with air until the temperature reached 450° C., quenched with a water spray (pressure of 6 bar) to 250° C. then quenched with air to room temperature; the fifth histogram bar in each group (the fifth bar of the second group is not included in FIG. 7) shows the yield strength of a sample quenched via the exemplary discontinuous quench, beginning when the alloy exited the solutionizing furnace and was quenched with air until the temperature reached 450° C., quenched with a water spray (pressure of 2 bar) to 250° C. then quenched with air to room temperature; and the sixth histogram bar in each group of bars shows the yield strength of a sample that was subjected to a continuous air-only quench.

Figure 8:
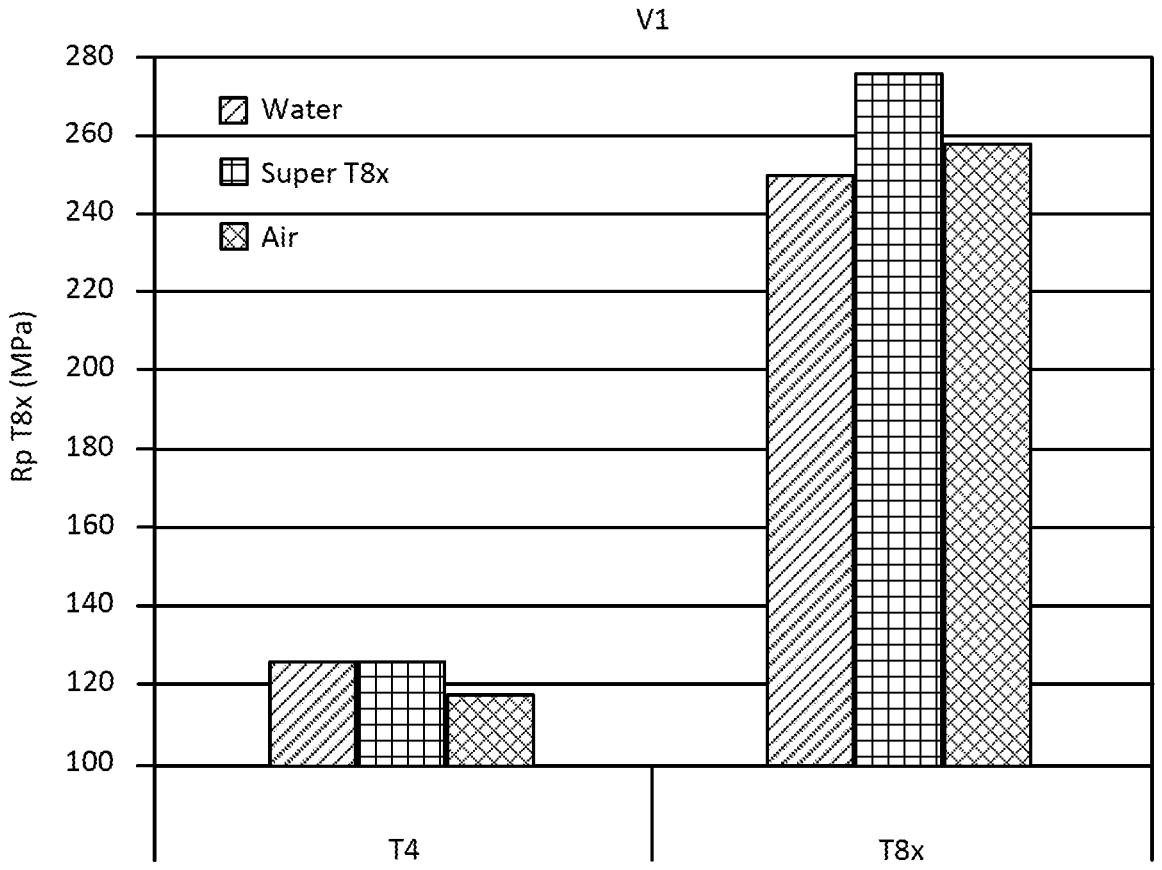
FIG. 8 is a bar chart showing yield strength of samples taken from an alloy described herein before and after a bake hardening procedure described herein.

FIG. 8 is a bar chart showing yield strength of Alloy V1 when Alloy V1 is in T4 temper (left set of histograms) and when Alloy V1 is in the exemplary T8x temper (right set of histograms). The first histogram bar in each set of bars shows the yield strength of a sample that was subjected to a full water quench; the second histogram bar in each set shows the yield strength of a samples quenched via the exemplary discontinuous quench; and the third histogram bar in each group shows the yield strength of a sample quenched with a continuous air-only quench.

Example 3

Figure 9:
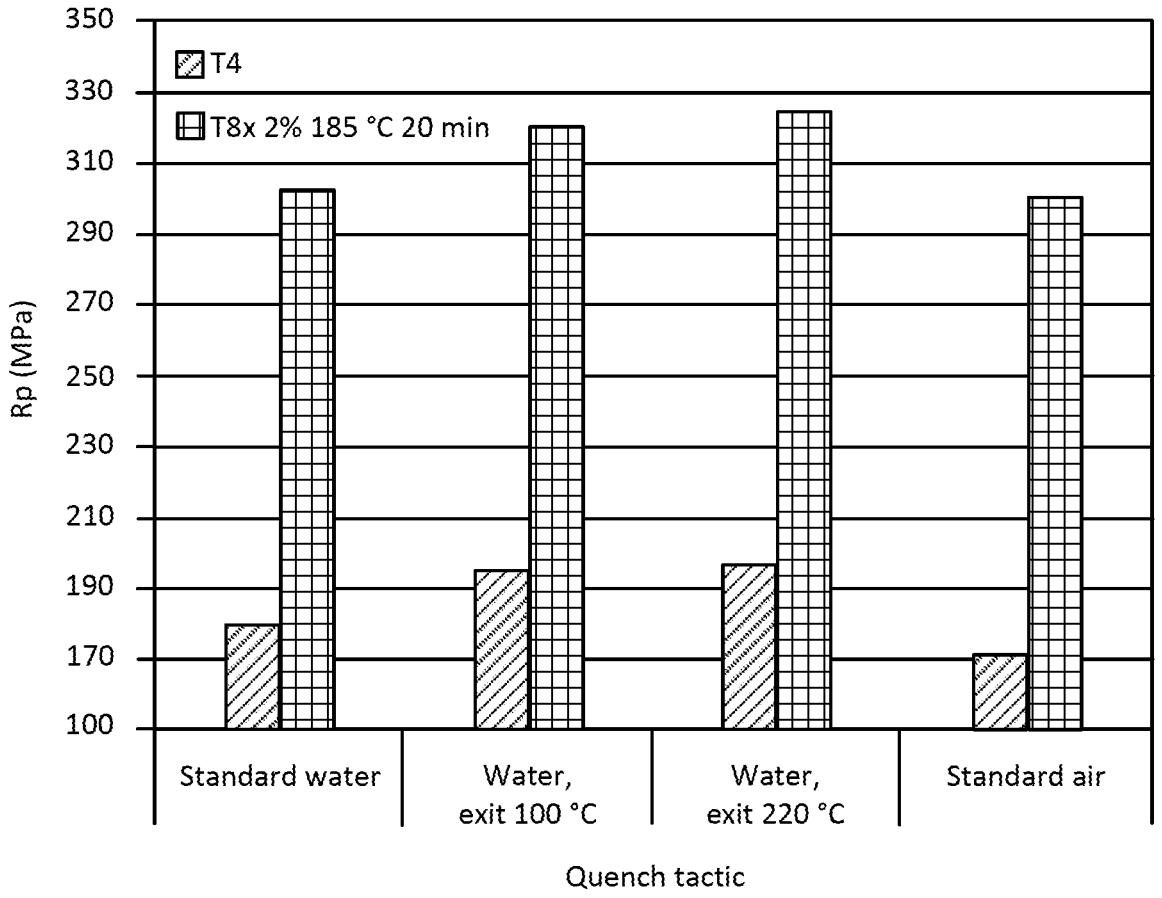
FIG. 9 is a bar chart showing yield strength of samples taken from an aluminum alloy described herein subjected to various methods of making described herein.

FIG. 9 shows the yield strength test results for samples having a composition comprising Alloy Al (see Table 1) produced in a manufacturing setting. The Alloy Al was subjected to various quenching techniques during processing. As shown in FIG. 9, a full water quench (first group of histogram bars, referred to as "Standard water"), air-only quench (fourth group of histogram bars, referred to as "Standard air") and exemplary discontinuous quenches beginning upon exiting the solutionizing furnace and then quenching with water to a temperature of 100° C. (second group of histogram bars, referred to as "Water, exit 100° C.") and 220° C. (third group of histogram bars, referred to as "Water, exit 220° C.") were employed. The yield strengths after natural aging (T4 temper) and deforming plus artificial aging (T8x temper, 2% strain then heating to 185° C. and maintaining 185° C. for 20 minutes) are shown. FIG. 9 shows effects of the exemplary quenching technique on aluminum alloys having a higher Cu content processed in a manufacturing setting.

Figure 10:
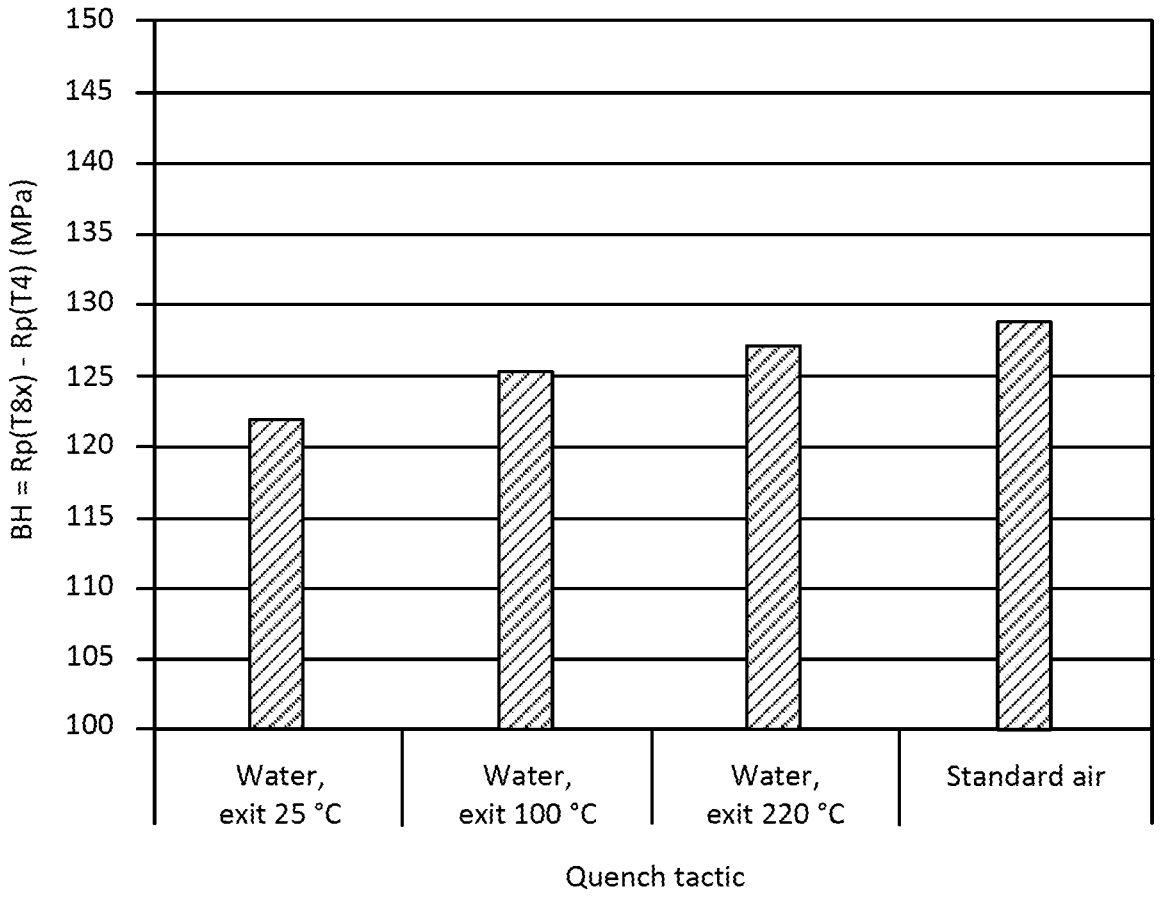
FIG. 10 is a bar chart showing a bake hardening response (i.e., increase in yield strength) of samples taken from an alloy described herein subjected to various methods of making described herein.

FIG. 10 presents the difference in yield strength of the Alloy Al samples in the exemplary T8x temper and comparative T4 temper condition. The bake hardening (BH) response indicated on the y-axis is a result of subtracting the recorded yield strength of Alloy Al in T4 temper from the recorded yield strength of Alloy Al in T8x temper as presented in FIG. 9.

Example 4

Figure 11:
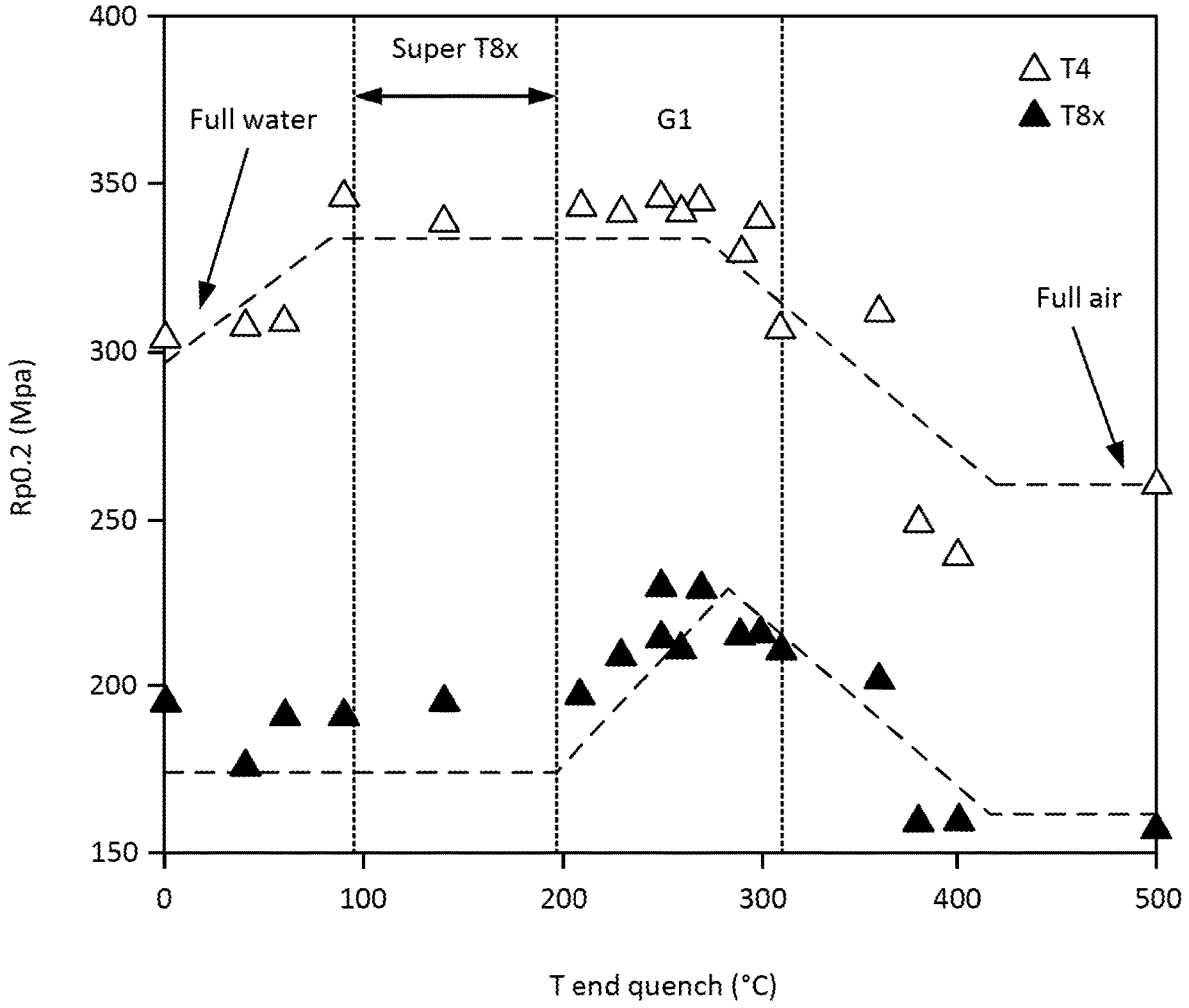
FIG. 11 is a graph showing yield strength of samples taken from an aluminum alloy described herein subjected to various methods of making described herein.
Figure 12:
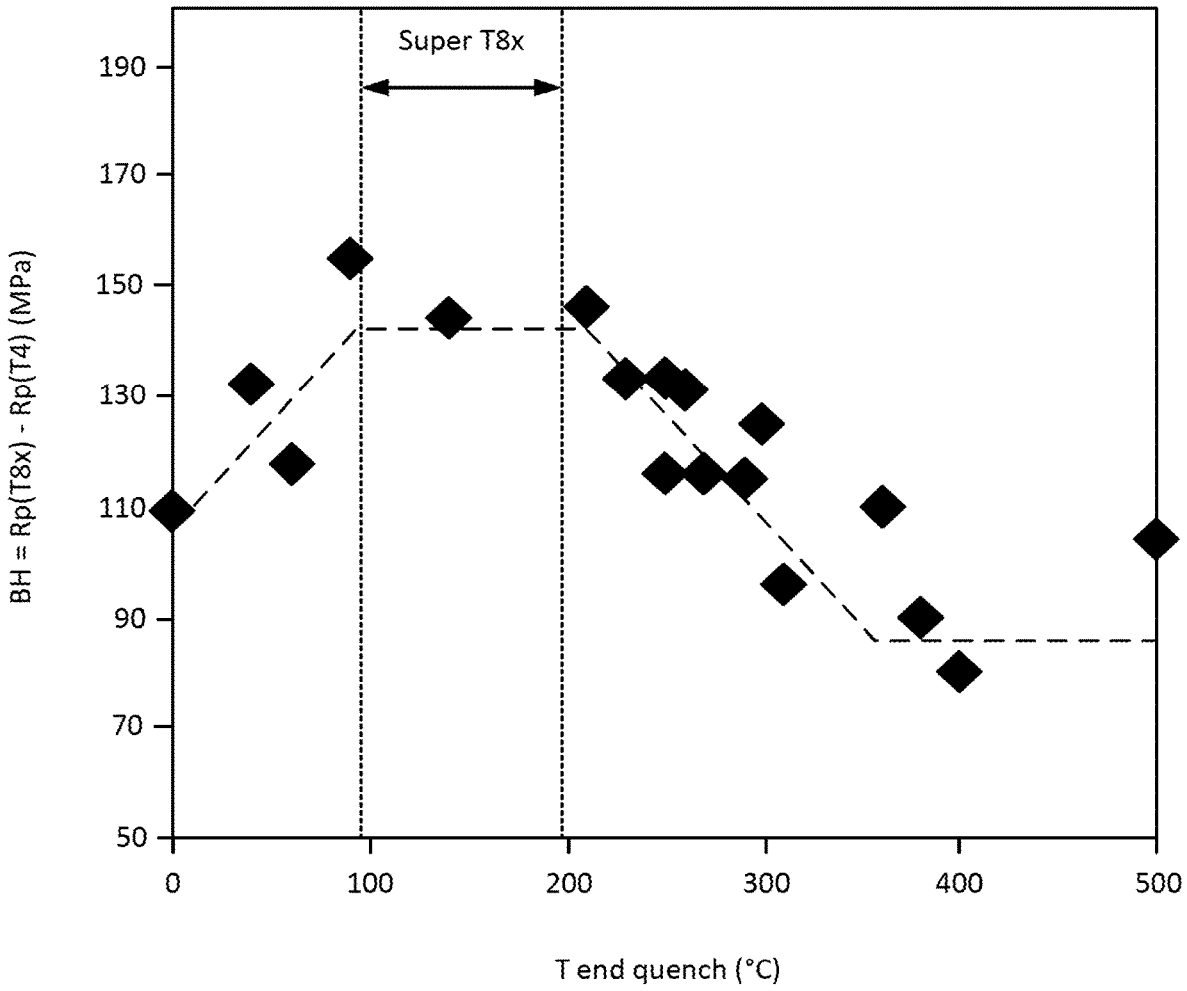
FIG. 12 is a graph showing a bake hardening response (i.e., increase in yield strength) of samples taken from an alloy described herein subjected to various methods of making described herein.

FIG. 11 shows the yield strength test results of the Alloy G1 samples described above after an optional artificial aging process described above was employed resulting in the exemplary T8x temper (upper line plot) and a natural aging process resulting in T4 temper (lower line plot). FIG. 11 shows the increase in yield strength of Alloy G1 subjected to the exemplary discontinuous quenching, ending the water quench when the solutionized coil temperature was between approximately 100° C. to 300° C. and beginning the air quench. Alloy G1 subjected to the exemplary quenching and optional aging results in an exemplary T8x temper. Also evident is the increase in yield strength of the naturally aged Alloy G1 subjected to the exemplary discontinuous quenching, ending the water quench when the solutionized coil temperature was between approximately 200° C. to 300° C. and beginning the air quench. Evident in the graph is the need to end the quenching at aluminum alloy temperatures between about 100° C. 200° C. FIG. 12 presents the difference in yield strength of the Alloy G1 samples in the exemplary T8x temper and comparative Alloy G1 samples that were not subjected to the exemplary discontinuous quenching and optional artificial aging (e.g., in a T4 temper condition). The bake hardening (BH) response indicated on the y-axis is a result of subtracting the recorded yield strength of comparative Alloy G1 in T4 temper from the recorded yield strength of Alloy G1 in the exemplary T8x temper.

Example 5

Exemplary Alloy Cl was subjected to various processes as described herein. In one example, after cold rolling Alloy Cl was solutionized (SHT), quenched with air (AQ) and pre-aged (PX) (referred to as "A" in FIG. 13 and Table 3). In another example, Alloy Cl was solutionized, quenched with air, flash heated (FX) for various times, further quenched with air and pre-aged (referred to as "B" in FIG. 13 and Table 3). In another example, Alloy Cl was solutionized, flash heated (FX) for various times, then quenched with air and pre-aged (referred to as "C" in FIG. 13 and Table 3).

Figure 13:
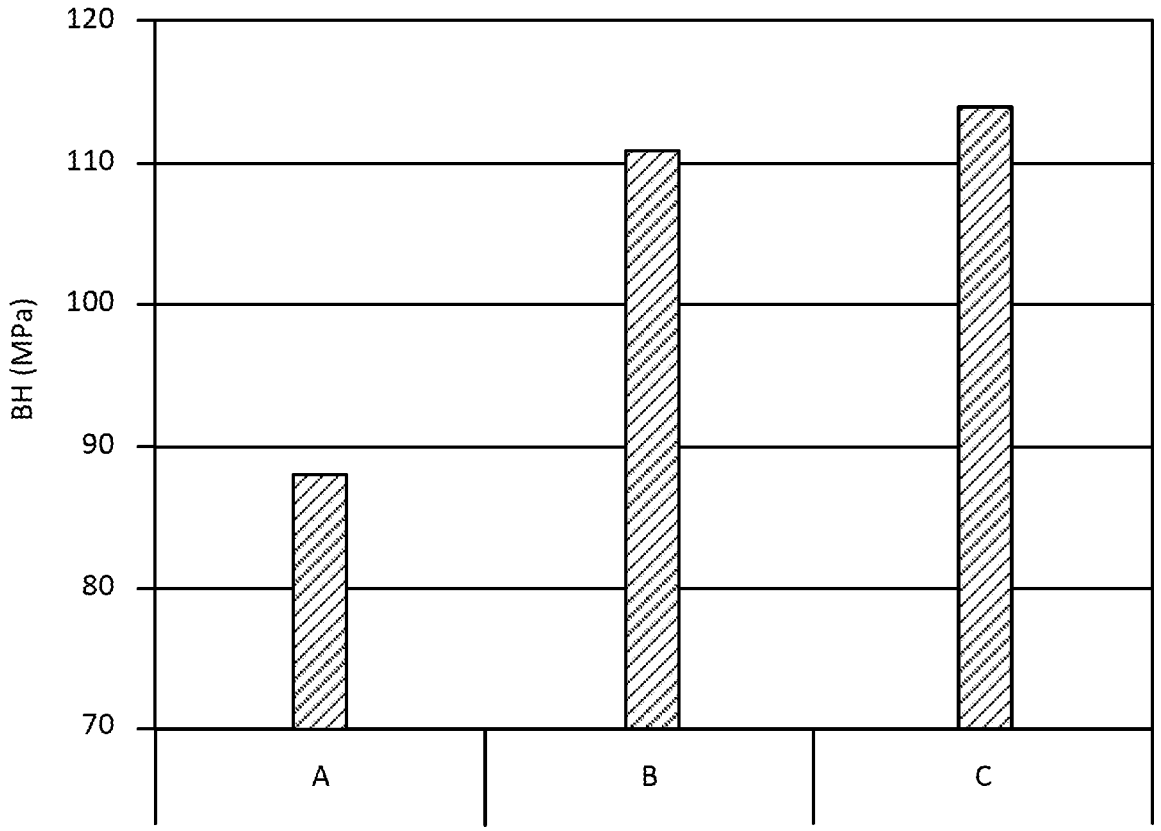
FIG. 13 is a graph showing a bake hardening response of samples taken from an alloy described herein subjected to various methods of making described herein.

FIG. 13 demonstrates the bake hardening response of exemplary Alloy Cl (see Table 1) when subjected to a modified processes described herein. In the second exemplary process, after the quench, the room temperature alloy is reheated to about 200° C. and maintained at 200° C. for about 10 seconds. Reheating (i.e., flash heating) provides an increase in the bake hardening response of the alloy. FIG. 13, center histogram B, demonstrates the approximately 23 MPa increase in yield strength. In another example, during the discontinuous quench (see FIG. 1), when the alloy reaches the discontinuity temperature (e.g., 200° C.) the alloy temperature is maintained for a period of time 130 before a secondary quench is started. Evident in FIG. 13, right histogram C, is the approximately 25 MPa increase in alloy yield strength. Strength results are shown in Table 3.

TABLE 3

| Effects of Flash Heating | | | | | | |
|---|---|---|---|---|---|---|
| | T4 | | | 2% + 170° C. – 20 min | | |
| Process | Rp02 [MPa] | Rm [MPa] | DC angle | Rp02 [MPa] | Rm [MPa] | BH [MPa] |
| A | 122 | 227 | 29 | 210 | 277 | 88 |
| B (200° C., 10 s FX) | 122 | 227 | 23 | 233 | 294 | 111 |
| B (200° C., 30 s FX) | 125 | 228 | 29 | 237 | 295 | 112 |
| B (200° C., 60 s FX) | 127 | 228 | 28 | 239 | 294 | 112 |
| C (300° C., 30 s FX) | 129 | 235 | 46 | 227 | 290 | 98 |
| C (200° C., 30 s FX) | 126 | 235 | 23 | 236 | 299 | 110 |
| C (200° C., 60 s FX) | 129 | 235 | 26 | 243 | 303 | 114 |

Rp0.2 = yield strength, Rm = tensile strength, DC = bend angle, and BH = bake hardening Evident in Table 3 is the increase in strength of Alloy Cl when subjected to the exemplary pre-aging combined with the flash heating step in T8x (2%+170° C.—20 min) temper. T4 temper indicates Alloy Cl that was not subjected to the pre-aging and flash heating. BH indicates the strength increase when the exemplary processes provide the alloy in T8x.

Example 6

Figure 14:
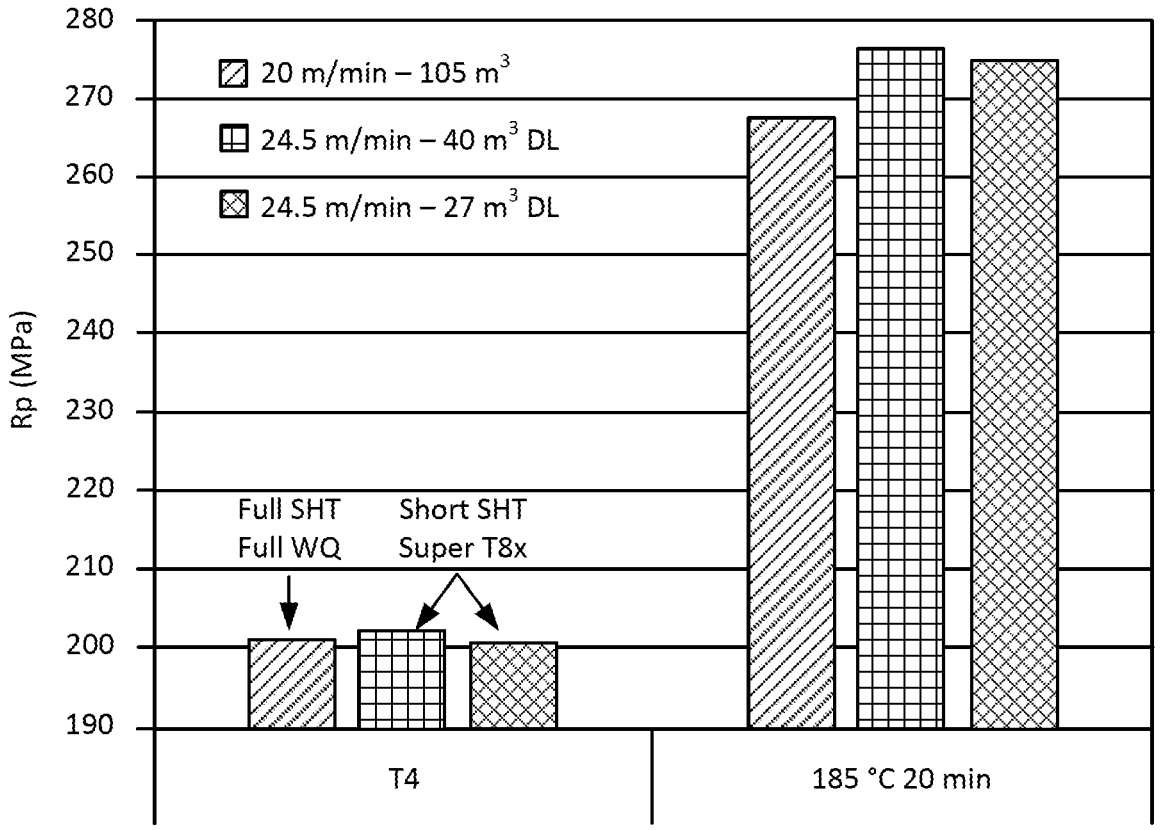
FIG. 14 is a graph showing resulting strength after the paint bake procedure for an exemplary aluminum alloy produced at varying line speeds according to methods described herein.

In some examples, employing the exemplary methods described herein can reduce processing time necessary to deliver a high strength aluminum alloy product by eliminating any need for a long duration thermal treatment (i.e., solutionizing). In some examples, an aluminum alloy, e.g., a sample Alloy B1, can be subjected to a comparative process including a long solutionizing step, a subsequent water quench that can include passing the aluminum alloy through a cascading flood of water and optionally employ an additional thermal treatment to artificially age the aluminum alloy and provide the aluminum alloy in a T8 or T8x temper. In some non-limiting examples, a sample Alloy B1 (having the same composition as the alloys subjected to the comparative process above) was produced according to exemplary discontinuous quench methods described herein. The exemplary discontinuous quench provided a process wherein the solutionizing step was shortened (e.g., solutionizing was performed for a period of time that was 25% smaller than the solutionizing step of the comparative process), and the discontinuous quench required less water (e.g., the cascading flood can use 105 cubic meters per hour ($m^3$/h) and the exemplary method can use from about 27 $m^3$/h to about 40 $m^3$/h (e.g., 27 $m^3$/h, 28 $m^3$/h, 29 $m^3$/h, 30 $m^3$/h, 31 $m^3$/h, 32 $m^3$/h, 33 $m^3$/h, 34 $m^3$/h, 35 $m^3$/h, 36 $m^3$/h, 37 $m^3$/h, 38 $m^3$/h, 39 $m^3$/h, or 40 $m^3$/h)). Additionally, the pre-aging provided an aluminum alloy in a T4 temper that was able to be strengthened further by additional heat treatment to provide an aluminum alloy in a T8 or T8x temper (e.g., artificial aging can be performed by a customer during, for example, a paint bake procedure and/or a post-forming heat treatment). In some examples, pre-aging in this manner served to partially age the aluminum alloy (e.g., provide the aluminum alloy in a T4 temper that can be artificially aged further to provide the aluminum alloy in, for example, a T8 or T8x temper). In some aspects, the pre-aging arrested natural aging in the aluminum alloy. In some further examples, subjecting the aluminum alloy to the paint baking procedure after the exemplary discontinuous quench and pre-aging finished artificially aging the aluminum alloy and provided Alloy B1 in the exemplary T8x temper. FIG. 14 is a graph showing resulting strength after the paint bake procedure for alloys produced at varying line speeds. Alloy B1 was processed at a line speed of 20 meters per minute (m/min) with a water quench of 105 $m^3$/h (left histogram in each group), 24.5 m/min with a water quench of 40 $m^3$/h (center histogram in each group), and a line speed of 24.5 m/min with a water quench of 27 $m^3$/h. "DL" (center and right histogram in each group) indicates the exemplary multi-step quench method was employed. For Alloy B1 in T4 temper, samples produced by the exemplary methods exhibit similar tensile strength to a sample produced by a comparative traditional method (i.e., 20 m/min with a long duration solutionizing step and a flooding water quench). Samples were further subjected to a paint bake procedure including a thermal treatment at a temperature of 185° C. for 20 minutes after 2% pre-straining. Tensile strength of all samples increased significantly after paint baking, however the samples produced by the exemplary quench and pre-aging exhibited higher tensile strengths than the sample produced by the comparative traditional method. A high-strength aluminum alloy can be achieved at a rate up to 25% faster than the comparative traditional method, reducing time and cost from shorter thermal treatment.

Figure 15:
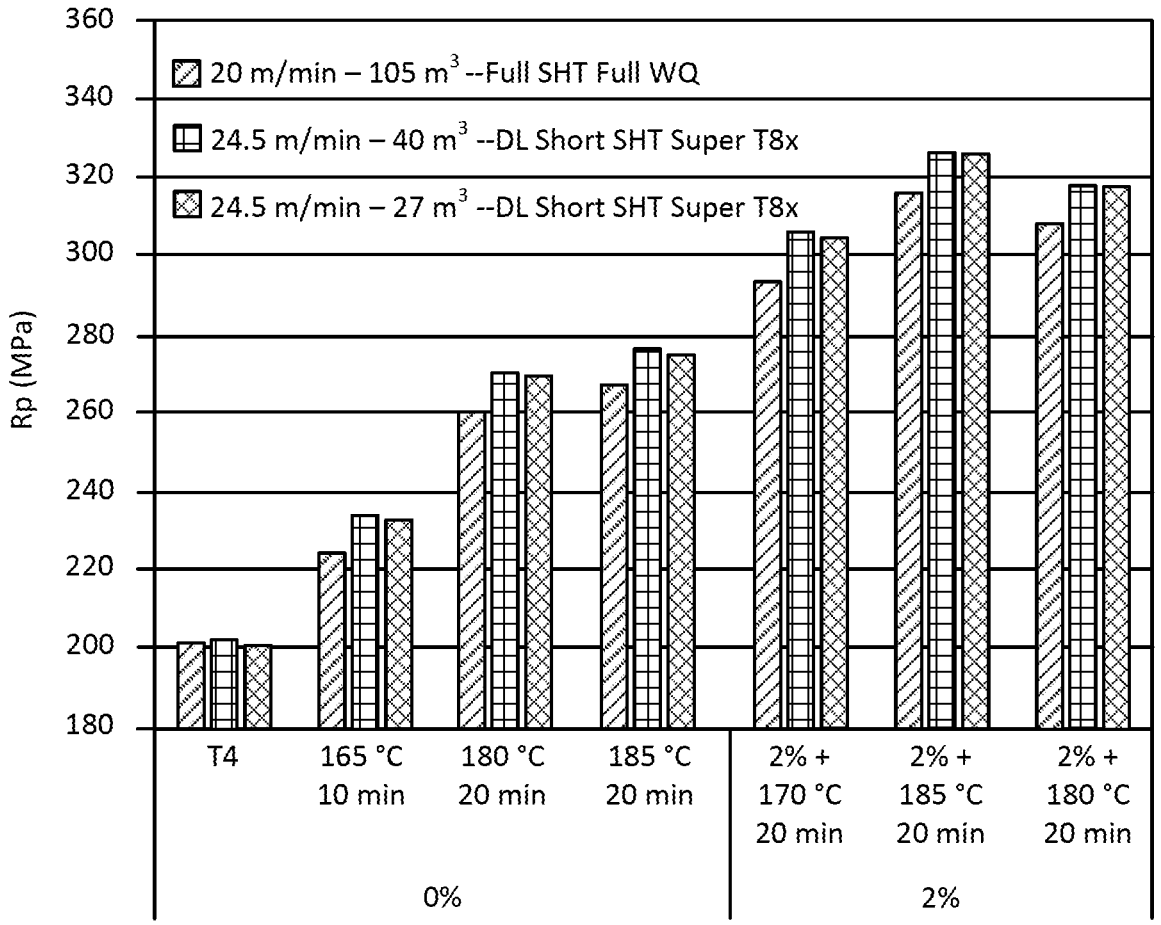
FIG. 15 is a graph showing measured tensile strength of various alloys made according to different methods and techniques.

FIG. 15 is a graph showing effects of various solution heat treatment techniques (referred to as "Full SHT," and "Short SHT"), various quench techniques, various pre-straining techniques (e.g., no pre-staining or pre-straining of 2%), and various paint baking techniques (x-axis) on tensile strength of Alloy B1 samples produced according to exemplary discontinuous quench methods described herein. Each Alloy B1 analyzed in this example comprises the same composition. The left histogram in each group shows Alloy B1 samples subjected to a comparative slower line speed (20 m/min), standard solution heat treatment (referred to as "Full SHT"), and standard water quench (referred to as "Full WQ") of 105 $m^3$/h. Subsequent pre-straining techniques and paint baking techniques are shown on the x-axis. The center and right histogram in each group show Alloy B1 samples subjected to a faster line speed (e.g., 24.5 m/min), the exemplary 25% shorter solution heat treatment (referred to as "Short SHT"), and exemplary discontinuous quench technique requiring less water for the water quench step of the exemplary discontinuous quench technique (e.g., 40 $m^3$/h (center histogram) and 27 $m^3$/h (right histogram)). Subsequent pre-straining techniques and paint baking techniques are shown on the x-axis. Tensile strength of all samples subjected to similar paint baking (i.e., a paint bake at a temperature of about 165° C. to about 185° C. for a duration of about 10 minutes to about 20 minutes) increased significantly after paint baking. The exemplary processing route, including the multi-step quench procedure and flash heating step can be used to provide aluminum alloys in a T4 temper that can be further strengthened when subjected to additional thermal processing techniques. For example, the aluminum alloys described herein can be produced according to the methods described above and delivered to a customer in a T4 temper. The customer can optionally employ additional heat treatments (e.g., paint baking after a painting process or post-forming heat treatment after a forming process) to further artificially age the aluminum alloy and provide the aluminum alloy in a T8 or T8x temper.

Example 7

Figure 16:
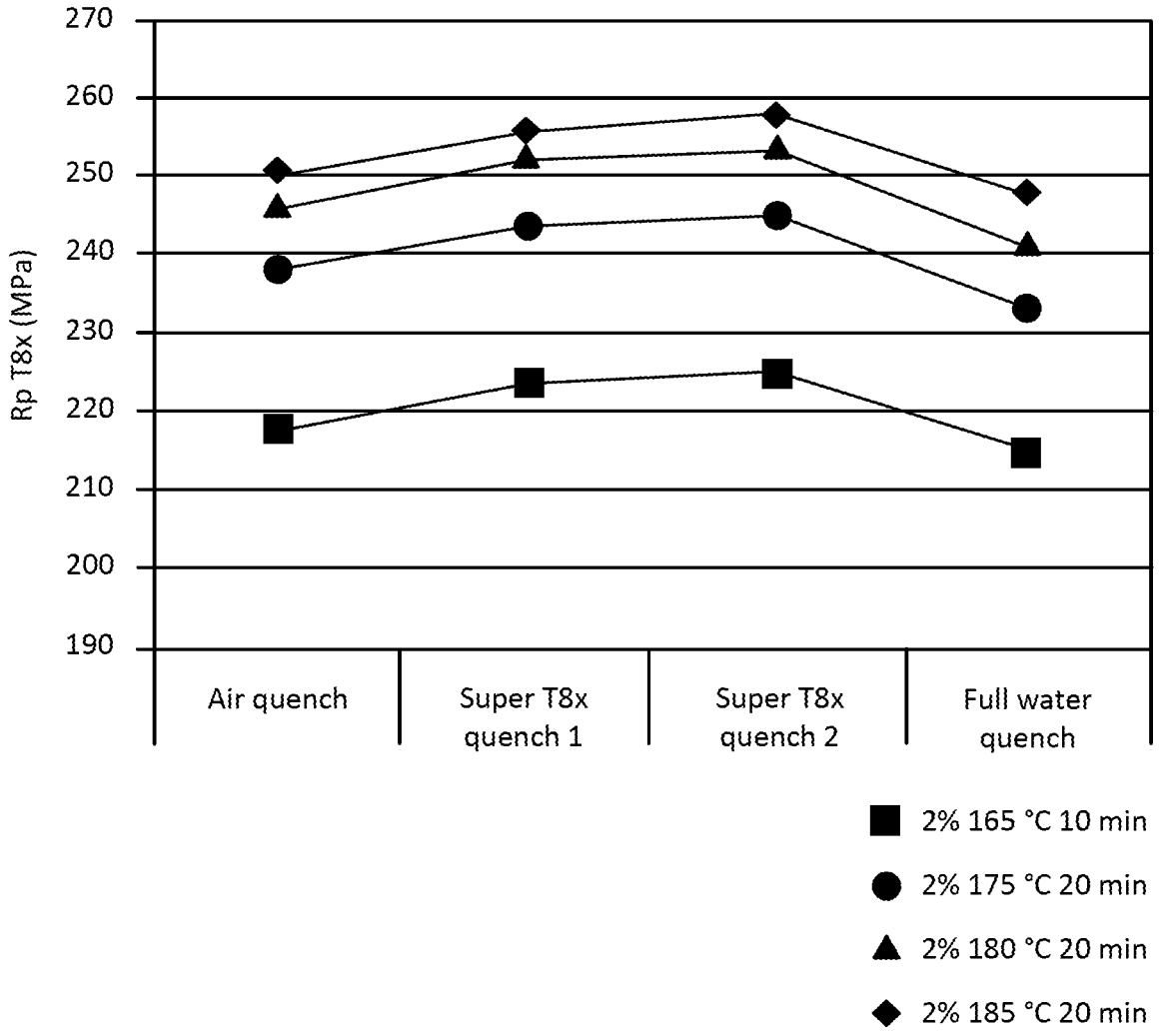
FIG. 16 is a graph showing yield strength of samples taken from an exemplary alloy in T8x temper and subjected to various paint baking procedures described herein.

FIG. 16 presents the yield strength test results of the exemplary quenching deformation and various paint baking techniques employed during processing of an exemplary aluminum alloy. Exemplary aluminum alloy V1 composition in this example is described in Table 2 above.

FIG. 16 shows an increased yield strength of exemplary Alloy V1 subjected to the exemplary discontinuous quenching, beginning the air quench when the solutionized coil exited the solutionizing furnace and changing to a water quench and then returning to an air quench for the remainder of the quenching. The alloy subjected to the exemplary quenching, deformation (e.g., a 2% strain applied to a yield strength test sample), and various paint baking results in an exemplary T8x temper. Paint baking variations included (i) heating to 165° C. and maintaining 165° C. for 15 minutes (indicated by squares), (ii) heating to 175° C. and maintaining 175° C. for 20 minutes (indicated by circles), (iii) heating to 180° C. and maintaining 180° C. for 20 minutes (indicated by triangles), and (iv) heating to 185° C. and maintaining 185° C. for 20 minutes (indicated by diamonds). In FIG. 16, the left point in each plot shows the yield strength of a sample that was subjected to a continuous air quench; the second from left point in each plot shows the yield strength of a sample quenched via an exemplary discontinuous quench described herein (referred to as "Super T8x quench 1"); the third from left point in each plot shows the yield strength of a sample quenched via an exemplary discontinuous quench described herein (referred to as "Super T8x quench 2"); and the right point in each plot shows the yield strength of a sample subjected to a continuous full water quench.

Figure 17:
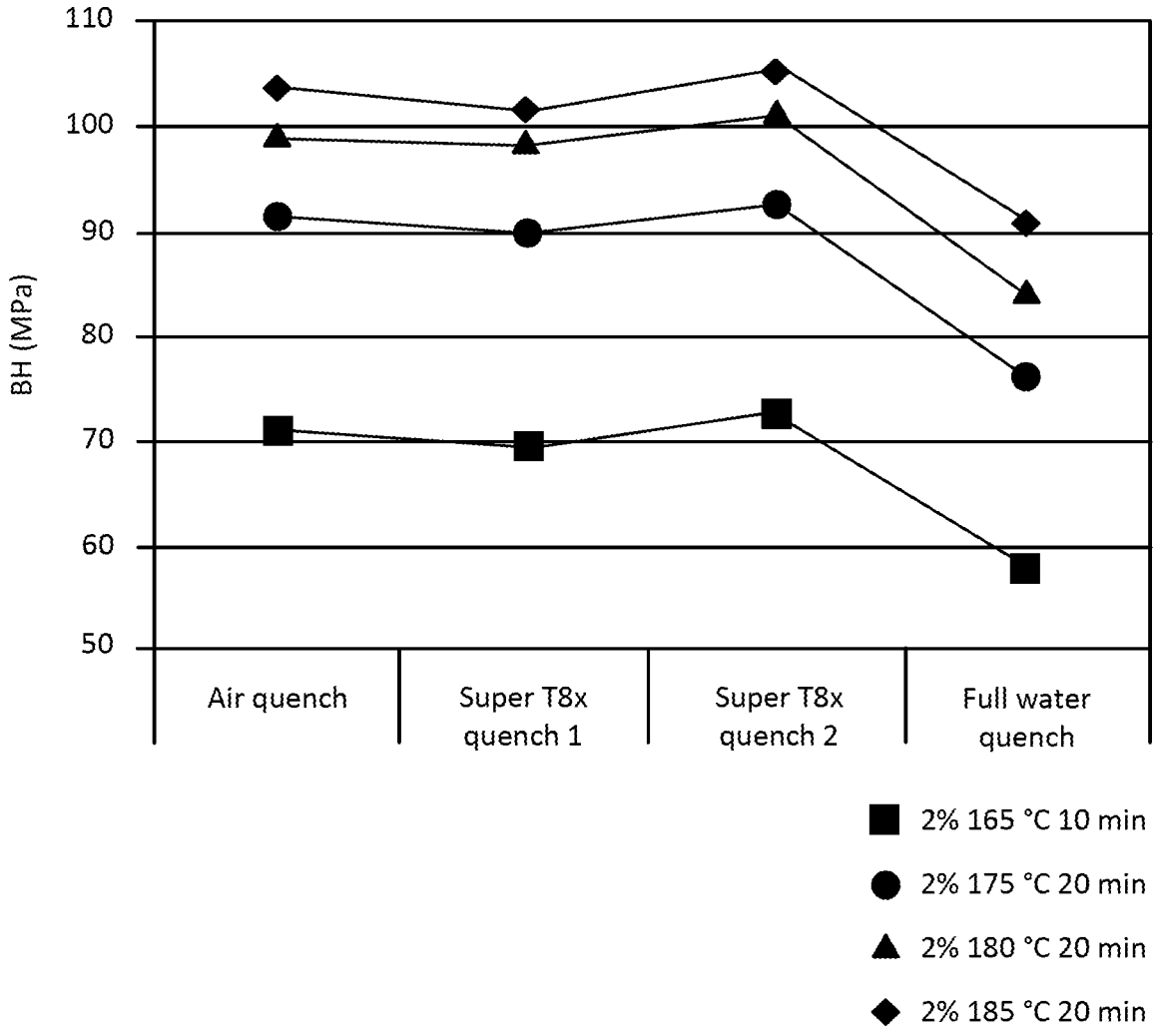
FIG. 17 is a graph showing a bake hardening response (i.e., increase in yield strength) of samples taken from an exemplary alloy and subjected to various paint baking procedures described herein.

FIG. 17 presents the difference in yield strength of the exemplary Alloy V1 sample in the exemplary T8x temper and comparative T4 temper. The bake hardening (BH) response indicated on the y-axis is a result of subtracting the recorded yield strength of Alloy V1 in T4 temper from the recorded yield strength of Alloy V1 in the exemplary T8x temper. Shown in FIG. 17, Alloy V1 was subjected to the exemplary discontinuous quenching, deformation (e.g., a 2% strain applied to a yield strength test sample), and various paint baking results in an exemplary T8x temper. Paint baking variations included (i) heating to 165° C. and maintaining 165° C. for 15 minutes (indicated by squares), (ii) heating to 175° C. and maintaining 175° C. for 20 minutes (indicated by circles), (iii) heating to 180° C. and maintaining 180° C. for 20 minutes (indicated by triangles), and (iv) heating to 185° C. and maintaining 185° C. for 20 minutes (indicated by diamonds). In FIG. 17, the left point in each plot shows the yield strength of a sample that was subjected to a continuous air quench; the second from left point in each plot shows the yield strength of a sample quenched via an exemplary discontinuous quench described herein (referred to as "Super T8x quench 1"); the third from left point in each plot shows the yield strength of a sample quenched via an exemplary discontinuous quench described herein (referred to as "Super T8x quench 2"); and the right point in each plot shows the yield strength of a sample subjected to a continuous full water quench.

Evident in FIGS. 16 and 17, the exemplary discontinuous quench technique provided alloys having increased yield strength regardless of paint baking procedures applied to the alloys. Additionally, a larger bake hardening response was observed after employing Super T8x quench 2 described above.

Figure 18:
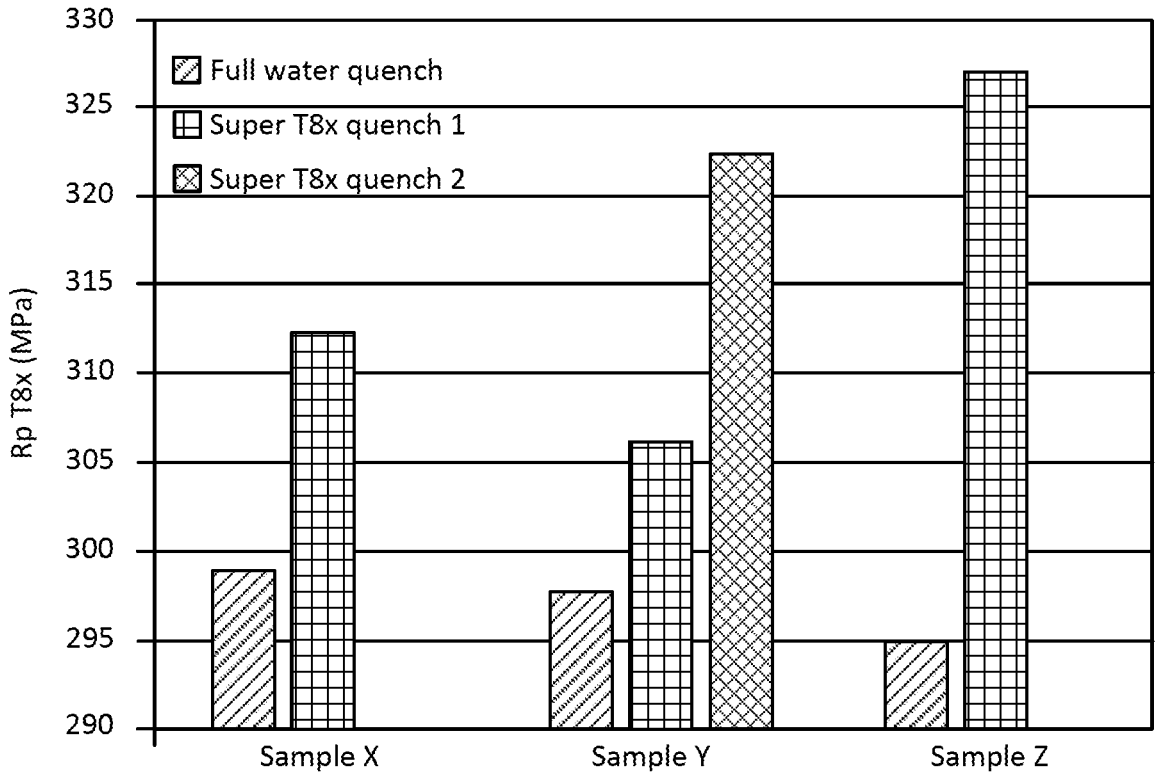
FIG. 18 is a bar chart showing yield strength of samples taken from an exemplary alloy in T8x temper described herein.

FIG. 18 presents the yield strength test results of the exemplary quenching deformation and various paint baking techniques employed during processing of an three aluminum alloy samples, Sample X, Sample Y, and Sample Z.

FIG. 18 shows an increased yield strength of aluminum alloy samples X, Y and Z subjected to the exemplary discontinuous quenching, beginning the air quench when the solutionized coil exited the solutionizing furnace and changing to a water quench and then returning to an air quench for the remainder of the discontinuous quenching. The alloys subjected to the exemplary quenching, deformation (e.g., a 2% strain applied to a yield strength test sample), and paint baking providing an exemplary T8x temper. Paint baking heating to 185° C. and maintaining 185° C. for 20 minutes. In FIG. 18, the left histogram in each group shows the yield strength of a sample that was subjected to a continuous full water quench; the second from left histogram in each group shows the yield strength of a sample quenched via the exemplary discontinuous quench in a first trial (referred to as "Super T8x quench 1"); the right histogram in each group shows the yield strength of a sample quenched via the exemplary discontinuous quench in a second trial (referred to as "Super T8x quench 2").

Figure 19:
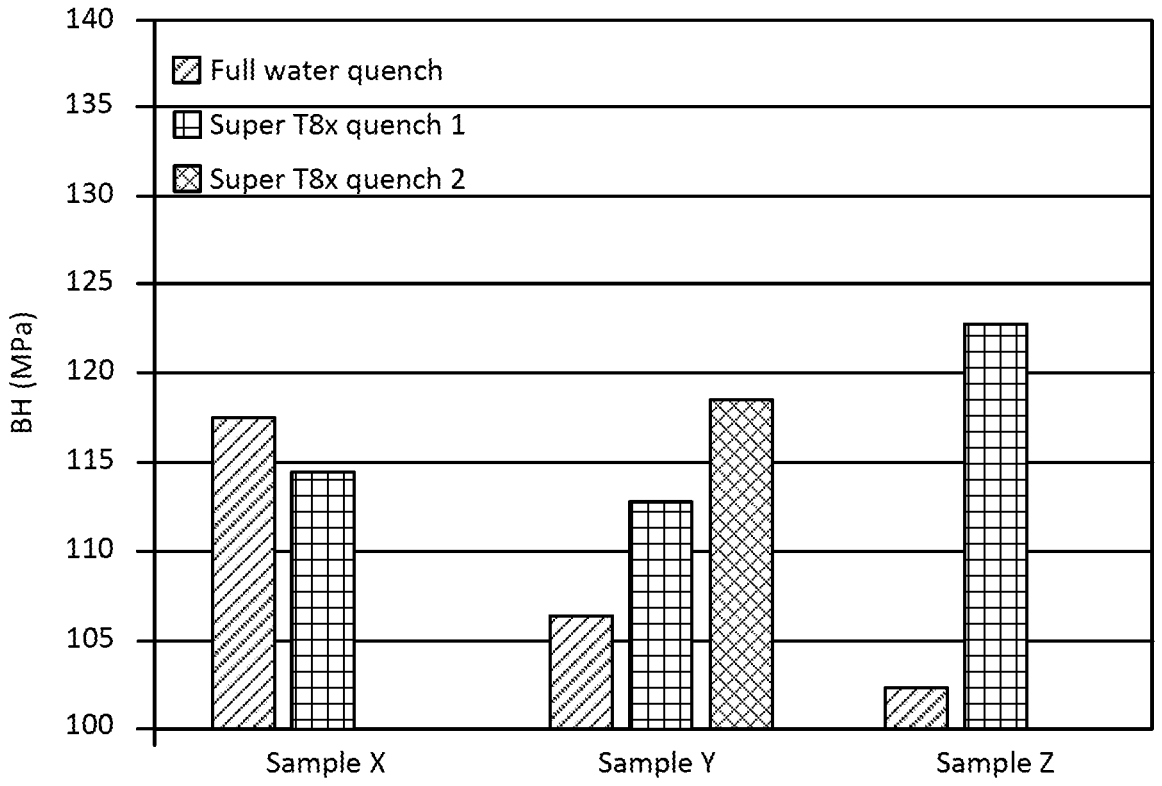
FIG. 19 is a bar chart showing a bake hardening response (i.e., increase in yield strength) of samples taken from an exemplary alloy described herein.

FIG. 19 presents the difference in yield strength of the aluminum alloy samples X, Y and Z in the exemplary T8x temper and comparative T4 temper. The bake hardening (BH) response indicated on the y-axis is a result of subtracting the recorded yield strength of aluminum alloy samples X, Y and Z in T4 temper from the recorded yield strength of aluminum alloy samples X, Y and Z in the exemplary T8x temper. Shown in FIG. 19, aluminum alloy samples X, Y and Z were subjected to the exemplary discontinuous quenching, deformation (e.g., a 2% strain applied to a yield strength test sample), and paint baking providing an exemplary T8x temper. Paint baking included heating to 185° C. and maintaining 185° C. for 20 minutes. In FIG. 19, the left histogram in each group shows the yield strength of a sample that was subjected to a continuous full water quench; the second from left histogram in each group shows the yield strength of a sample quenched via an exemplary discontinuous quench described herein (referred to as "Super T8x quench 1"); the right histogram for Alloy Al shows the yield strength of an Alloy Al sample quenched via an exemplary discontinuous quench described herein (referred to as "Super T8x quench 2").

Evident in FIGS. 18 and 19, the exemplary discontinuous quench technique provided alloys having increased yield. Additionally, a larger bake hardening response was observed after employing the exemplary discontinuous quench technique described above, with the exception of aluminum alloy sample X, which exhibited a slight decrease in the bake hardening response.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

What is claimed is:

1. A method of producing an aluminum alloy comprising:

casting an aluminum alloy to form a cast aluminum product, wherein the aluminum alloy comprises 0.45±1.5 wt. % Si, 0.1±0.5 wt. % Fe, up to 1.5 wt. % Cu, 0.02±0.5 wt. % Mn, 0.45±1.5 wt. % Mg, up to 0.5 wt. % Cr, up to 0.01 wt. % Ni, up to 0.1 wt. % Zn, up to 0.1 wt. % Ti, up to 0.1 wt. % V, and up to 0.15 wt. % of impurities;

homogenizing the cast aluminum product;

hot rolling the cast aluminum product to produce an aluminum alloy body of a first gauge;

cold rolling the aluminum alloy body to produce an aluminum alloy plate, shate or sheet having a final gauge;

solutionizing the aluminum alloy plate, shate or sheet;

quenching the aluminum alloy plate, shate or sheet;

coiling the aluminum alloy plate, shate or sheet into a coil; and aging the coil wherein the quenching comprises multiple steps, wherein the multiple steps comprise:

a first quenching to a first temperature;

a second quenching to a second temperature; and a third quenching to a third temperature.

2. The method of claim 1, wherein the first quenching is performed with air.

3. The method of claim 1, wherein the second quenching is performed with water.

4. The method of claim 1, wherein the third quenching is performed with air.

5. The method of claim 1, wherein the first temperature is in a range from approximately 400° C. to approximately 550° C.

6. The method of claim 1, wherein the second temperature is in a range from approximately 200° C. to approximately 300° C.

7. The method of claim 1, wherein the third temperature is in a range from approximately 20° C. to approximately 25° C.

8. The method of claim 1, further comprising flash heating the coil, the flash heating comprising heating the coil to a temperature between about 180° C. to 250° C. for about 5 seconds to 60 seconds.

9. The method of claim 1, wherein the method provides an aluminum alloy processing line with improved speed such that aluminum alloy processing time is reduced by at least 20%.

10. The method of claim 1, further comprising pre-aging the coil.

11. The method of claim 10, wherein the quenching and pre-aging provide improved yield strength.

12. The method of claim 1, further comprising pre-straining the coil.

13. The method of claim 1, further comprising a paint baking step.

14. A method of producing an aluminum alloy comprising:

casting an aluminum alloy to form a cast aluminum product, wherein the aluminum alloy comprises 0.45±1.5 wt. % Si, 0.1±0.5 wt. % Fe, up to 1.5 wt. % Cu, 0.02±0.5 wt. % Mn, 0.45±1.5 wt. % Mg, up to 0.5 wt. % Cr, up to 0.01 wt. % Ni, up to 0.1 wt. % Zn, up to 0.1 wt. % Ti, up to 0.1 wt. % V, and up to 0.15 wt. % of impurities;

hot rolling the cast aluminum product to produce an aluminum alloy body of a first gauge;

cold rolling the aluminum alloy body to produce an aluminum alloy plate, shate or sheet having a final gauge;

coiling the aluminum alloy plate, shate or sheet into a coil;

solutionizing the coil;

quenching the coil to room temperature;

flash heating the coil, wherein flash heating the coil comprises heating the coil to a temperature between about 180° C. to 250° C. for about 5 seconds to 60 seconds; and pre-aging the coil.

15. The method of claim 14, further comprising a paint baking step.

16. The method of claim 15, wherein the flash heating and the paint baking provide improved yield strength.

17. The method of claim 1, wherein the first temperature is in a range from approximately 400° C. to approximately 550° C., the second temperature is in a range from approximately 200° C. to approximately 300° C., and the third temperature is in a range from approximately 20° C. to approximately 25° C.

18. A method of producing an aluminum alloy comprising:

casting an aluminum alloy to form a cast aluminum product, wherein the aluminum alloy comprises 0.45±1.5 wt. % Si, 0.1±0.5 wt. % Fe, up to 1.5 wt. % Cu, 0.02±0.5 wt. % Mn, 0.45±1.5 wt. % Mg, up to 0.5 wt. % Cr, up to 0.01 wt. % Ni, up to 0.1 wt. % Zn, up to 0.1 wt. % Ti, up to 0.1 wt. % V, and up to 0.15 wt. % of impurities;

homogenizing the cast aluminum product;

hot rolling the cast aluminum product to produce an aluminum alloy body of a first gauge;

cold rolling the aluminum alloy body to produce an aluminum alloy plate, shate or sheet having a final gauge;

solutionizing the aluminum alloy plate, shate or sheet;

quenching the aluminum alloy plate, shate or sheet;

coiling the aluminum alloy plate, shate or sheet into a coil; and aging the coil, wherein the quenching comprises multiple steps, wherein the multiple steps comprise:

a first quenching to a first temperature, wherein said first quenching is performed by air;

a second quenching to a second temperature, wherein the second quenching is performed by water; and a third quenching to a third temperature, wherein the third quenching is performed by air.

19. The method of claim 18, wherein the first temperature is in a range from approximately 400° C. to approximately 550° C., the second temperature is in a range from approximately 200° C. to approximately 300° C., and the third temperature is in a range from approximately 20° C. to approximately 25° C.

20. The method of claim 18, further comprising flash heating the coil, the flash heating comprising heating the coil to a temperature between about 180° C. to 250° C. for about 5 seconds to 60 seconds.

* * * * *